US007419042B2

(12) United States Patent
Enomoto et al.

(10) Patent No.: US 7,419,042 B2
(45) Date of Patent: Sep. 2, 2008

(54) AUTOMATIC COIN ALIGNING APPARATUS AND METHOD

(75) Inventors: Minoru Enomoto, Iwatsuki (JP); Shigeo Kawauchi, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/966,601

(22) Filed: Oct. 15, 2004

(65) Prior Publication Data

US 2005/0142998 A1 Jun. 30, 2005

(30) Foreign Application Priority Data

Oct. 21, 2003 (JP) ..... 2003-361184
Mar. 26, 2004 (JP) ..... 2004-092103

(51) Int. Cl.
*G07F 1/04* (2006.01)
*G07F 9/10* (2006.01)

(52) U.S. Cl. ..... 194/350

(58) Field of Classification Search ..... 194/350; 193/15; 221/130, 131
See application file for complete search history.

(56) References Cited

U.S. PATENT DOCUMENTS 423,589 A 3/1890 Besly
944,198 A * 12/1909 Maw ..... 232/15
1,419,437 A * 6/1922 Angers ..... 209/137
1,423,589 A 7/1922 Wood
2,306,155 A 12/1942 Carlton
2,423,589 A 7/1947 Ericson
3,423,589 A 1/1969 Bardwell et al.
3,590,833 A 7/1971 Walton
3,650,085 A 3/1972 Bay
4,195,751 A * 4/1980 Smith ..... 221/17
4,275,751 A 6/1981 Bergman
4,326,620 A 4/1982 Felix et al.
4,346,798 A * 8/1982 Agey, III ..... 194/348
4,423,589 A 1/1984 Hardin et al.
4,541,444 A 9/1985 Okada
5,017,176 A * 5/1991 Swierczek ..... 453/49
5,172,829 A * 12/1992 Dellicker, Jr. ..... 221/13
5,423,589 A 6/1995 Pank
5,562,536 A 10/1996 Uchida et al.
5,667,096 A * 9/1997 Wu ..... 221/6
5,695,395 A * 12/1997 Ota et al. ..... 453/57
5,813,510 A * 9/1998 Rademacher ..... 194/206
6,068,158 A 5/2000 Chabout
6,082,578 A * 7/2000 Miyoshi et al. ..... 221/92
6,165,063 A 12/2000 Perkitny
6,165,064 A * 12/2000 Aurelius et al. ..... 453/18
6,193,599 B1 2/2001 Kurosawa et al.
6,249,574 B1 * 6/2001 Taylor et al. ..... 379/150

(Continued)

*Primary Examiner*—Patrick Mackey
*Assistant Examiner*—Mark Beauchaine

(57) ABSTRACT

An automatic coin aligning apparatus including a coin storing unit, a chute section, and a dispensing control unit. The chute section is disposed above the coin storing unit and has an upper portion and a lower portion. The chute section upper portion extends to receive coins from a plurality of coin hoppers, the chute section lower portion extends to a coin storing section. The coin storing unit includes a plurality of coin storing sections. Each coin storing section can receive a predetermined quantity of coins from a coin hopper. Each coin hopper can store a bulk quantity of coins of a predetermined denomination and dispense coins in a one by one manner. The dispensing control unit controls the coin dispensing quantity of the plurality of coin hoppers.

18 Claims, 26 Drawing Sheets

U.S. PATENT DOCUMENTS 6,423,589 B2 7/2002 Park et al.
6,726,056 B2 * 4/2004 Yuyama et al. ..... 221/124
6,983,836 B2 1/2006 Adams et al.
6,991,530 B2 * 1/2006 Hino et al. ..... 453/3
7,018,286 B2 3/2006 Blake et al.
2004/0231955 A1 * 11/2004 Carter ..... 194/217

* cited by examiner

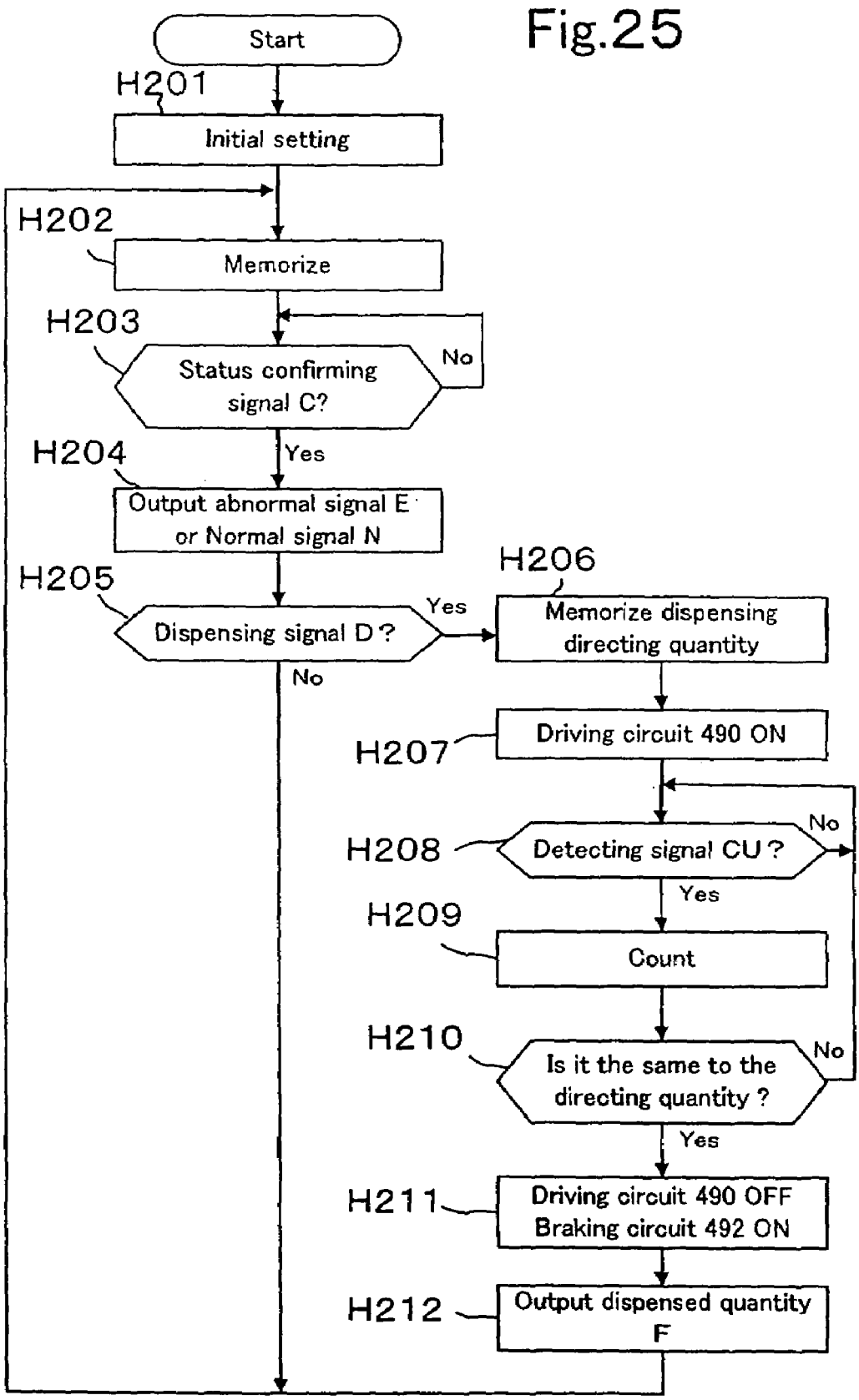
Fig.25
Start
H201
Initial setting
H202
Memorize
H203
Status confirming signal C?
No
Yes
H204
Output abnormal signal E or Normal signal N
H205
Dispensing signal D?
Yes
No
H206
Memorize dispensing directing quantity
H207
Driving circuit 490 ON
H208
Detecting signal CU?
No
Yes
H209
Count
H210
Is it the same to the directing quantity?
No
Yes
H211
Driving circuit 490 OFF
Braking circuit 492 ON
H212
Output dispensed quantity F

AUTOMATIC COIN ALIGNING APPARATUS AND METHOD

CROSS-REFERENCE TO RELATED APPLICATION

This application is based on application number 2003-361184 filed in Japan, dated Oct. 21, 2003, and application number 2004-092103 filed in Japan, dated Mar. 26, 2004.

FIELD OF THE INVENTION

This invention is related to a coin guiding apparatus and more particularly to an automatic coin aligning apparatus for guiding coins from a plurality of coin hoppers into a coin storing unit having a plurality of coin storing sections.

DESCRIPTION OF RELATED ART

In reference to FIG. 26, a traditional coin storing unit 10 can used with a change dispensing apparatus such as that shown in patent document WO 03/015038A. Coins are dispensed from coin hoppers and accumulated in a predetermined quantity according to their denominations. The coin storing unit 10 includes a coin storing body 16 and cover 20. The coin storing body 16 includes a plurality of storing sections 14, each having a diameter that is slightly larger than the diameter of the desired stored coin. Each storing section 14 extends perpendicularly and has an opening 12 in the longitudinal direction. The cover 20 is detachable from the coin storing body 16 and encloses both the side openings 12 and the upper openings 18 of the storing sections 14.

There is a front side opening in the coin storing unit 10 between the lowermost end 22 of the cover 20 and the bottom 24 of the coin storing body 16. There is a back side opening in the coin storing unit 10 within which a pushing member can be inserted and moved in a reciprocating manner so that the lowest coin in the storing section 14 can be pushed out. In this manner, a predetermined quantity of a predetermined denomination can be dispensed.

According to the prior art, in order to supply a quantity of coins to the storing sections 14, a cumbersome process is required. First, a stack of coins of a certain denomination is wrapped up within a sheet of paper in a columnar form. Second, the wrapped column of coins is inserted into an upper opening 18 of the storing section 14 corresponding to the particular denomination of the stacked coins. Third, the wrapping sheet is removed from the stacked coins. Such an operation takes time, energy, and is inefficient. Further, it is also wasteful of paper.

In another solution, a mixture of various denominations of coins is supplied to a tray. The mixture of coins is then separated by a rotating disk in a one by one manner, after which the separated coins are stored in the appropriate cylindrical storing section such as in the U.S. Pat. No. 4,275,751 granted to Bergman, especially FIGS. 1-4 and pages 6-8. In the prior art, the denominations are intermixed so that a denomination separating unit is required, resulting in a less compact apparatus. Another solution relies on a one by one sorting process (either electrical or mechanical) that can slow down the supplying of coins to the proper storing sections.

SUMMARY OF THE INVENTION

The present invention, as defined in the claims, overcomes the deficiencies of the prior art by providing an automatic coin aligning apparatus where predetermined denominations can be accumulated at predetermined quantities without the use of paper wrappers, more quickly and efficiently. Secondly, the present invention achieves this result in a more compact apparatus. Third, the present invention teaches a novel auxiliary cover for a coin storing unit.

The present invention, in one embodiment, teaches an automatic coin aligning apparatus including a coin storing unit, a chute section, and a dispensing control unit. The chute section is disposed above the coin storing unit and has an upper section and a lower section. The chute section upper section extends to receive coins from a plurality of coin hoppers, the chute section lower portion extends to a coin storing section. The coin storing unit includes a plurality of coin storing sections. Each coin storing section can receive a predetermined quantity of coins from a coin hopper. Each coin hopper can store a bulk quantity of coins of a predetermined denomination and dispense coins in a one by one manner. The dispensing control unit controls the coin dispensing quantity of the plurality of coin hoppers.

According to another embodiment, the plurality of coin hoppers each include a dispensing slot and are disposed in one of two lines. The coin hopper dispensing slots of the coin hoppers in the first line facing the coin hopper dispensing slots of the coin hoppers in the second line. According to another embodiment, the plurality of coin hoppers include a rotating disk for dispensing coins in a one by one manner. The rotating disk includes at least one through hole. Each through hole can receive and move a single coin. The rotating disk through holes are located at evenly spaced intervals around the rotating disk when more than one through hole is present.

According to another embodiment, the chute section includes a buffering unit for dissipating a portion of the kinetic energy carried by a dispensed coin. According to another embodiment, the chute section is disposed on an angle to slant from between about 20 degrees to about 40 degrees as measured from the horizontal plane. According to another embodiment, the dispensing control unit includes a plurality of setting sections for setting a predetermined dispensing quantity for each of the plurality of coin hoppers, a coin hopper counting section within each coin hopper for counting coins dispensed from the coin hopper, and a coin hopper stopping section within each coin hopper for stopping the dispensing of coins from the coin hopper once the dispensing quantity equals the predetermined dispensing quantity.

According to another embodiment, the automatic coin aligning apparatus includes a holding section for releasably holding the coin storing unit at a predetermined position disposed below the chute section. According to another embodiment, the holding section is operable via a selecting attaching unit to be located at either a supplying position or a standby position. The supplying position is a position below the chute section, while the standby position is adjacent to the chute section. The selecting attaching unit is attached to a portion of an enclosure containing a portion of the automatic coin aligning apparatus.

According to another embodiment, each coin hopper includes a slanting base, a rotating disk, a dispensing slot for dispensing a coin, and a guiding passageway. The dispensing slot is disposed above the slanting base, while the guiding passageway extends perpendicularly from the dispensing slot and is parallel to the slanting base. The guiding passageway has a lower portion disposed over the chute section upper portion. According to another embodiment, a buffering unit is disposed opposite the dispensing slot and adjacent to the guiding passageway. The buffering unit is pivotable so as to extend in a downward direction.

According to another embodiment, an auxiliary cover for an automatic coin aligning apparatus includes a coin storing unit, a lower cover member, and an upper cover member. The coin storing unit has a plurality of coin storing sections arranged in parallel. The lower cover member encloses a lower opening of the coin storing unit. The upper cover member is located above the upper end of the coin storing unit and is detachable from the coin storing unit. According to another embodiment, the upper cover includes a resinous material. More generally, the upper cover is made of resin.

According to another embodiment, an auxiliary cover for an automatic coin dispensing and aligning apparatus includes a coin storing unit, and a cover for enclosing a lower opening of the coin storing unit. The coin storing unit has a plurality of coin storing sections arranged in parallel. The auxiliary cover extends to the upper end of the coin storing section to cover the sides of a chute section lower portion. The cover is removable from the coin storing section.

According to another embodiment, a method of automatically aligning coins in a coin dispenser includes the steps of dispensing a coin from a coin hopper into a guiding channel, buffering the dispensed coin with a first buffer unit within the guiding channel to dissipate a portion of the kinetic energy of the dispensed coin, sliding the dispensed coin received from the guiding channel along a chute section, and accumulating the sliding coin from the chute section into a coin storing section. The method can further include buffering the dispensed coin with a second buffer unit within the chute section to further dissipate a portion of the kinetic energy of the dispensed coin.

According to another embodiment, a coin aligning apparatus includes an array of coin hoppers, a coin storing unit having a plurality of coin storing sections, a chute section located below the array of coin hoppers and above the coin storing unit, and a dispensing control unit for controlling the coin dispensing quantity of the array of coin hoppers. The chute section is divided into a plurality of chute channels where each chute channel has an upper portion and a lower portion.

Each chute channel upper portion extends upward to receive coins dispensed from a predetermined coin hopper, and each chute channel lower portion extends downward to a predetermined coin storing section, so that a coin received by a chute channel upper portion is conducted to travel to the chute channel lower portion and into the predetermined coin storing section.

A first buffering unit within a chute channel in the chute section dissipates kinetic energy from the dispensed coin when the dispensed coin strikes the first buffering unit. The first buffering unit can include a first buffering body that extends across the chute channel where the first buffering body is operable to pivot in a swinging motion in the direction of the coin travel through the chute channel. A dispensed coin imparts kinetic energy to the first buffering body when the dispensed coin strikes the first buffering unit.

According to an embodiment, each coin hopper includes a slanting base at a first angle, a rotating disk for dispensing coins in a one by one manner, a dispensing slot for dispensing the coins, a guiding passageway that extends perpendicularly from the dispensing slot and located parallel to the slanting base, and a second buffering unit opposite the dispensing slot and adjacent to the guiding passageway. The guiding passageway has a lower portion disposed over the chute section upper portion. The second buffering unit is pivotable and extends in a downward direction.

The second buffering unit dissipates kinetic energy from the dispensed coin when the dispensed coin strikes the second buffering unit. The dispensing slot is located above the slanting base so that the dispensed coin is ejected in a slightly upward manner at an angle. The second buffering unit includes a second buffering body that extends across the guiding passageway. The second buffering body is operable to pivot in a swinging motion in the direction of the coin travel through the guiding passageway. A dispensed coin imparts kinetic energy to the second buffering body when the dispensed coin strikes the second buffering unit.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 25 is a flow diagram showing the operation of a coin hopper processing unit in accordance with an embodiment of the present invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
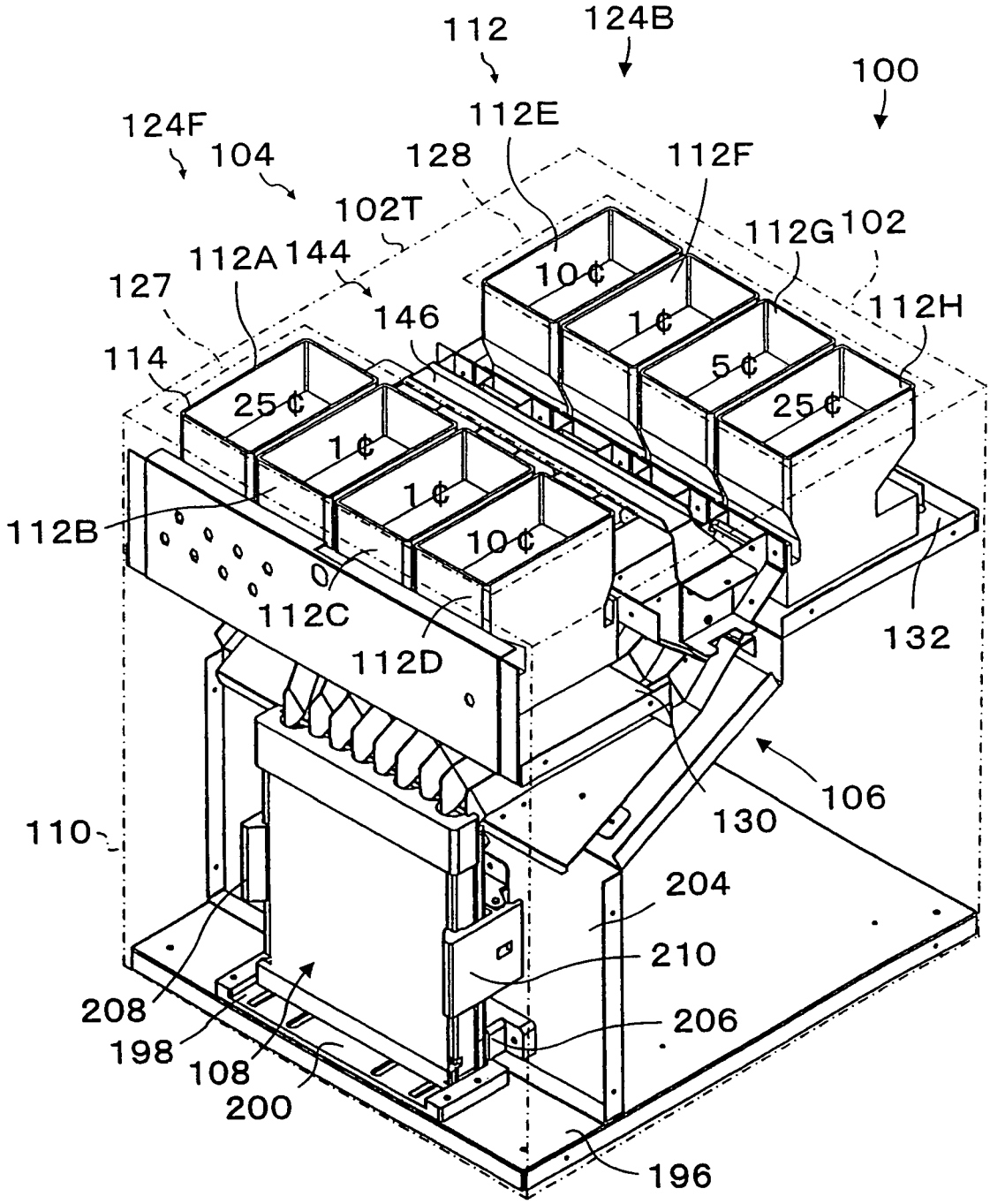
FIG. 1 is a perspective view of an automatic coin aligning apparatus in accordance with an embodiment of the present invention.

In reference to FIG. 1, an embodiment of the automatic coin aligning apparatus 100 is shown and explained. A coin aligning apparatus 100 includes a coin hopper section 104, a chute section 106, and a coin storing section 108. The chute section 106 is located beneath the coin hopper section 104 and guides the dispensed coins. The coin storing unit 108 is located below the chute unit 106 and receives the coins that have slid down the chute section. These units are located within a box-like enclosure 102 containing the automatic coin aligning apparatus. The coin storing unit 108 is located relatively close to the opening 110 on a side wall of the enclosure 102 to facilitate easy access to and allowing for removal and replacement of the coin storing unit 108.

The coin hopper section 104 includes at least four coin hoppers 112 which correspond to at least four different coin denominations. These coin hoppers 112 are located in the coin hopper section 104 and each one stores the coins in bulk according to their denomination and dispenses the coins in a one by one manner. The four different denominations can be United States minted coins in 25-cent, 10-cent, 5-cent, and 1-cent denominations, but coins of other origin and denominations may also be used.

An embodiment of the automatic coin aligning apparatus 100 includes eight coin hoppers 112A-H so that each denomination has at least one coin hopper 112. For example, coin hoppers 112A and 112H correspond to 25-cent denomination coins, coin hoppers 112D and 112E correspond to 10-cent denomination coins, coin hopper 112G corresponds to 5-cent denomination coins, and coin hoppers 112B, 112C, and 112F correspond to 1-cent denomination coins. All eight coin hoppers 112 include a rectangular bowl 114 for storing the particular coins in bulk, a rotating disk 118 rotated by an electric motor 116 located at the bottom of the bowl 114, and a coin sensor 120 located at a dispensing slot. Alternatively, a coin hopper 112 not including a rotating disk 118 may be used.

Figure 9:
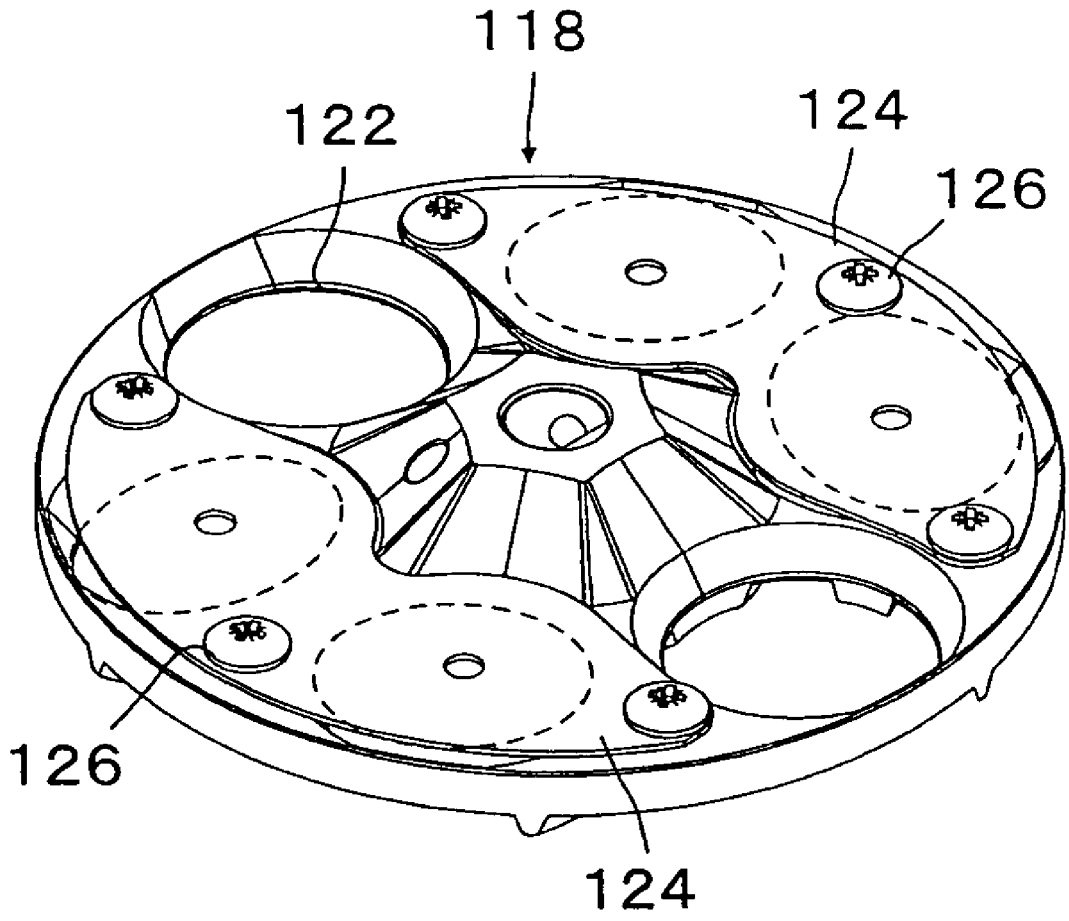
FIG. 9 is a perspective view of the rotating disk for use in a coin hopper in accordance with an embodiment of the present invention.

A suitable coin hopper 112 is described by U.S. Pat. No. 5,562,536 to Uchida et al. and U.S. Pat. No. 6,193,599 to Kurosawa et al. The rotating disks 118 described in the above mentioned patents include four or more through holes. In this case, the coins may be dispensed too quickly which can prevent the proper accumulation of coins above the rotating disk 118. To address this issue, one or more through hole covers 124 can be attached to the rotating disk 118, as shown in FIG. 9. Each through hole cover 124 can be attached to the rotating disk 118 by one or more screws 126. The through hole cover 124 reduces the number of available through holes 122 allowing coins in the coin hopper 112 to accumulate properly, be dispensed more slowly, and permits the dispensed coins to be aligned by a less complex apparatus.

Figure 5:
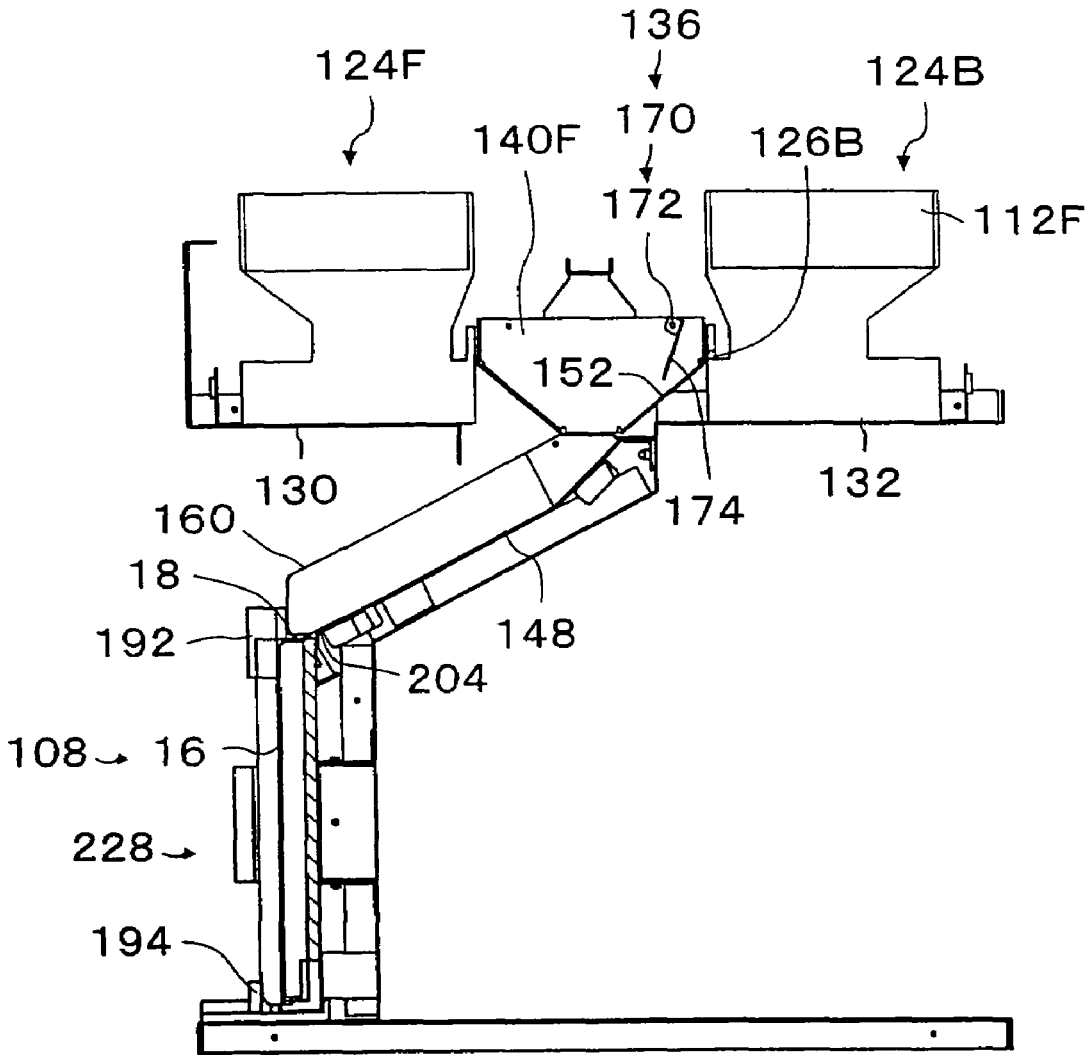
FIG. 5 is a cross-sectional view along the A-A line as shown in FIG. 3 in accordance with an embodiment of the present invention.
Figure 6:
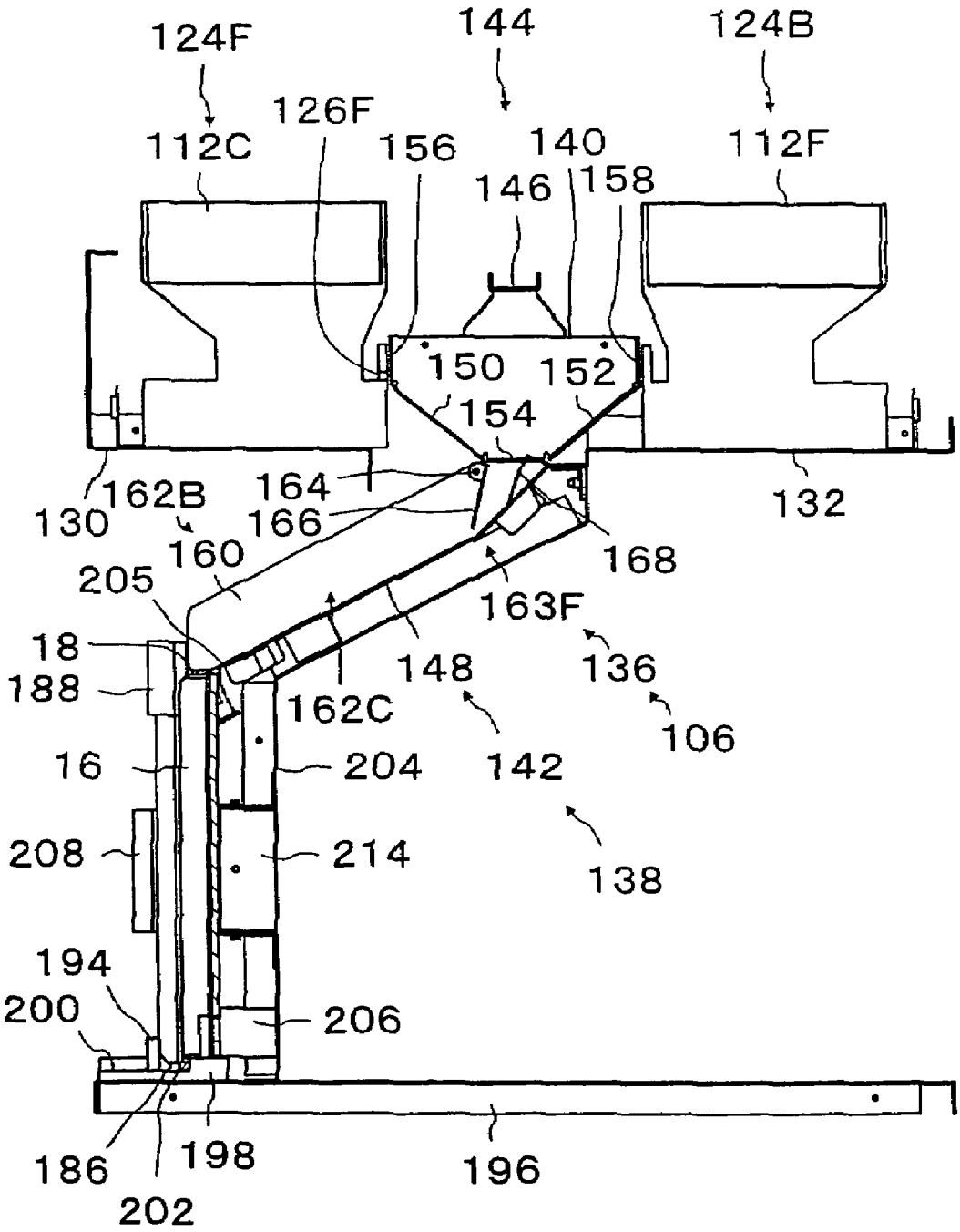
FIG. 6 is a cross-sectional view along the B-B line as shown in FIG. 3 in accordance with an embodiment of the present invention.

The storing section 108 can have at least two denominations determined by a statistical analysis indicating which two or more denominations are most highly used. For more complete coverage, eight coin hoppers (112A-112H) are included for dispensing four different denominations, as shown in FIG. 1. These eight coin hoppers 112 are aligned in an array format along two parallel lines identified as the front row 124F having four coin hoppers 112A-112D and a back row 124B having four coin hoppers 112E-112H. FIGS. 5 and 6 show the dispensing slots for the coin hoppers of each row face each other and are offset from each other in a staggered formation so that each of the eight coin hoppers can dispense coins simultaneously without interference. Specifically, the front dispensing slots 126F of the front row 124F face the back dispensing slots 126B of the back row 124B so that the eight coin hoppers dispense coins into the upper chute section 140.

In the front row 124F, 25-cent coins are stored in and dispensed by coin hopper 112A, 1-cent coins are stored in and dispensed by coin hoppers 112B-112C, and 10-cent coins are stored in and dispensed by coin hopper 112D. In the back row 124B, 25-cent coins are stored in and dispensed by coin hopper 112H, 5-cent coins are stored in and dispensed by coin hopper 112G, 1-cent coins are stored in and dispensed by coin hopper 112F, and 10-cent coins are stored in and dispensed by coin hopper 112E. A plurality of the appropriate denomination coins can be stored in bulk within the coin hoppers 112.

A top board 102T covers the top face of the box-like enclosure 102. A first lid 127 within the top board 102T covers the coin receiving sections for the coin hoppers 112A-112D in the front row 124F. A second lid 128 within the top board 102T covers the coin receiving sections for the coin hoppers 112A-112D in the back row 124B. The coin hoppers 112A-112D of the front row 124F can be affixed to a first base 130 located in the upper section of the box-like enclosure 102 and oriented horizontally in a level manner. Similarly, the coin hoppers 112E-112H of the back row 124B can be fixed to a second base 132 located in the upper section of the box-like enclosure 102 and oriented horizontally in a level manner. The second base 132 is mounted on an upper section of a base 196.

In reference to FIG. 6, the chute section 106 is shown and explained. The chute section 106 is located under the dispensing slots 126F and 126B of the coin hoppers 112. The chute section 106 includes a buffering unit 136 and a sliding section 138 for receiving the coins dispensed by the coin hoppers 112 and guiding the received coins as they slide down by gravity along a chute plate 148 in a lower chute section 142 of the chute section 106. The chute section 106 includes upper chute sections 140 and a lower chute sections 142. The upper chute sections 140 have a funnel-shaped cross-section and are located between the front row 124F and the back row 124B for ease of maintenance. The upper chute sections 140 together form the upper chute unit 144.

Buffering units 136 dissipate a portion of the kinetic energy carried by the coins as they are dispensed by the coin hoppers 112. The sliding section 138 guides the dispensed coins from the buffering unit 136. Buffering units 136 are located at different positions for the coin hoppers 112A-112D of the front row 124F and coin hoppers 112E-112H of the back row 124B.

A handle 146 is gate-like in shape and is attached at the upper chute unit 144. When the handle 146 is lifted up, the upper chute unit 144 can be removed. The upper chute sections 140 include a first slanting section 150 which slants from the front row 124F to the rear row 124B, a second slanting section 152 which slants from the rear row 124B to the front row 124F, and a falling slot 154 which is located between the lower end sections of the slanting sections (150, 152). A front wall 156 extends upwards and perpendicularly from an upper end of the first slanting section 150. A rear wall 158 extends upwards and perpendicularly from an upper end of the second slanting section 152. In this manner, the front wall 156 and the rear wall 158 are located approximately parallel at a predetermined distance. This predetermined distance is slightly more narrow than the separation between the front row 124F and the rear row 124B.

Figure 3:
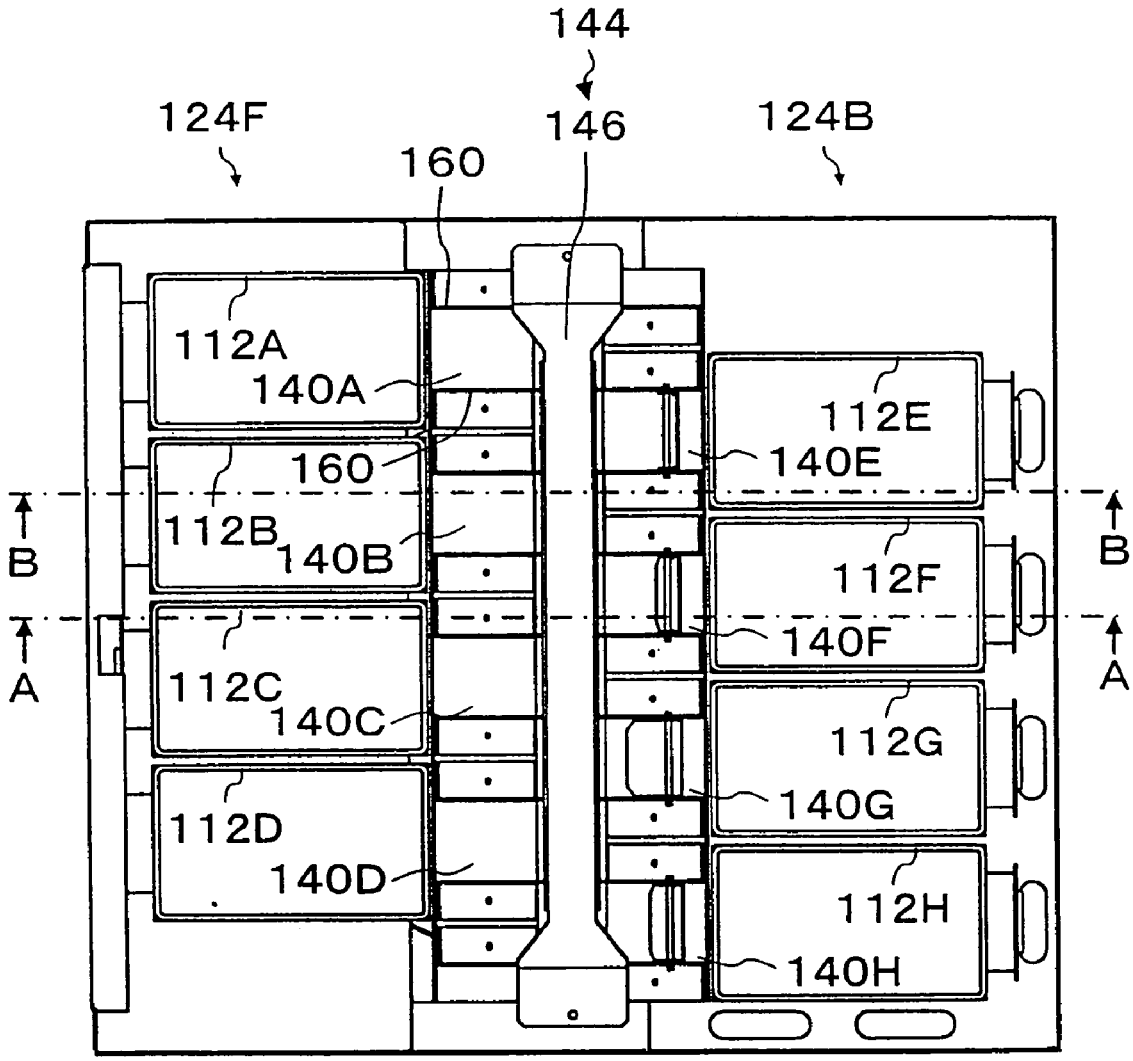
FIG. 3 is a top planar view of an automatic coin aligning apparatus in accordance with an embodiment of the present invention.

In reference to FIG. 3, separating walls 160 are affixed at the first slanting sections 150 and second slanting sections 152 and are located at a predetermined distance which are put down across from the dispensing slots 126F or 126B of the coin hoppers 112. Specifically, the upper chute sections 140A-140H are located corresponding to each coin hopper 112A-112H respectively.

Figure 2:
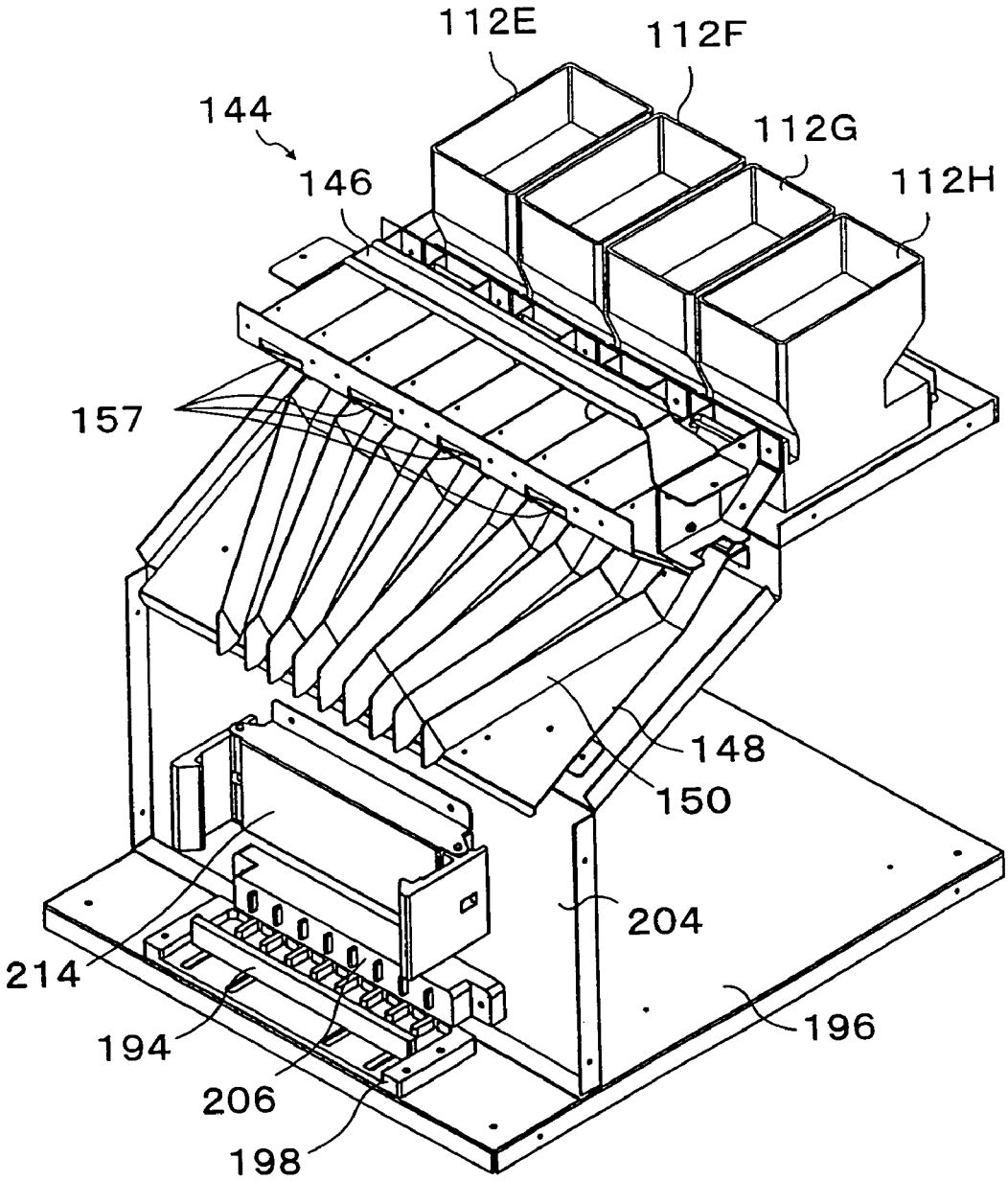
FIG. 2 is a perspective view showing the front side coin hoppers and the rear side coin hoppers detached from the automatic coin aligning apparatus in accordance with an embodiment of the present invention.

In reference to FIGS. 2 and 6, coin through holes 157 have an elongated, rectangular shape for receiving dispensed coins from corresponding coin hoppers 112. The front wall 156 can include four coin through holes 157 arranged to receive coins dispensed from coin hoppers 112A-112D. Similarly, the rear wall 158 can include four coin through holes 157 arranged to receive coins dispensed from coin hoppers 112E-112H. The lower chute section 142 includes the chute plate 148 which slants downwards and includes a plurality of guiding grooves (162A-162H) and may be denoted as chute channels 162. The upper end section of the lower chute section 142 is located under the upper chute section 140 while the lower end section of the lower chute section 142 is located under the front row 124F. The chute channels 162 are formed by the lower separating walls 160 which are attached to extend perpendicularly from the chute plate 148 at a predetermined distance.

The chute plate 148 can slant at an angle of between about 20 degrees to about 40 degrees as measured from the horizontal, but preferably slants at about 25 degrees. When the slanting angle is greater than 40 degrees, the sliding speed of the coins on the chute plate 148 can be too fast and the dispensed coins may not be properly accumulated. Conversely, when the slanting less than about 20 degrees the sliding speed of the coins on the chute plate 148 can be too slow, and some coins may stop sliding on the chute plate 148. The upper end of the guiding grooves 162 are positioned to correspond with the upper chute 140 in order to receive coins from the associated coin hopper 112. The lower portions of the chute channels 162 are located over corresponding storing sections 14 in the storing unit 108.

Figure 4:
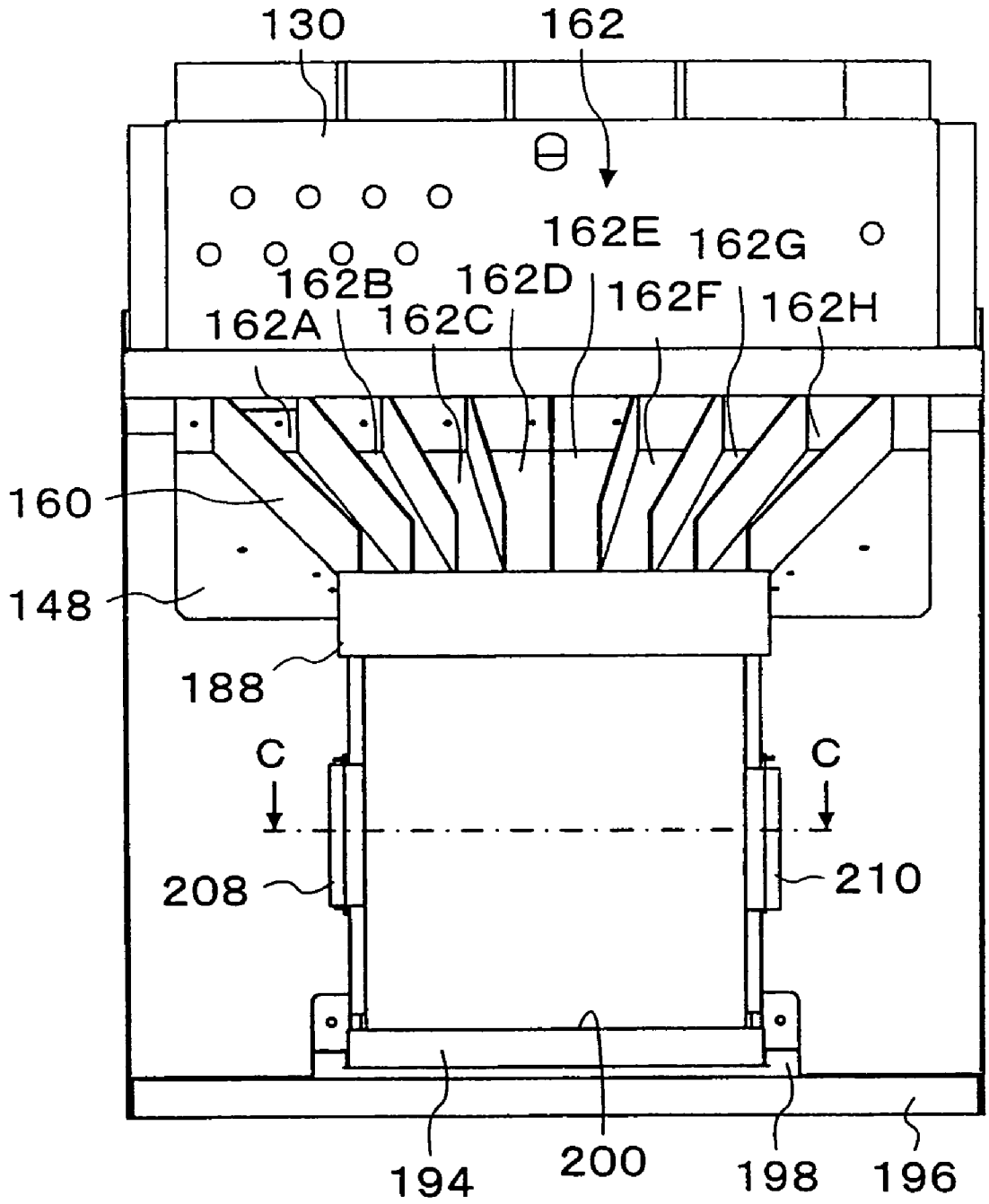
FIG. 4 is a front planar view in accordance with an embodiment of the present invention.

In reference to FIG. 6, the upper portions of the guiding grooves 162 are located under the falling slots 154 of the corresponding upper chutes and are the same size as the falling slots 154. In reference to FIG. 4, the guiding grooves 162 are located with their corresponding upper chutes 140 and are symmetric about a center point in a fan-fold manner.

In reference to FIGS. 5 and 6, the buffering units 136 are shown and explained. The buffering units 136 reduce or absorb the force of a dispensed coin to facilitate the proper sliding of the coins along the chute section 106 and collecting of the dispensed coins in the appropriate storing section 14 in the coin storage section 108. The buffering units 136 are divided into a two structures depending on whether the particular buffering unit 136 is associated with a coin hopper 112A-112D on the front row 124F or a coin hopper 112E-112H on the back row 124B.

In reference to FIG. 6, the buffering units 136 associated with coin hoppers 112A-112D are shown and explained. Using the buffering unit 136 associated with the coin hopper 112C as an example, the upper end of a first buffering body 166 is plate-like in shape and extends across the chute channel 162C to cross the direction of the coin travel through the chute channel 162C. This first buffering body 166 can pivot at a first shaft 164 that is attached at the upper end section of the lower separating wall 160 describing a swinging motion along the longitudinal direction of the coin travel through the chute channel 162C. The first shaft 164 is horizontal and crosses the dispensing direction of the coins from the coin hopper 112C at a right angle. In the standby position, the first buffering body 166 rests at an angle with the lower section of the first buffering body 166 away from the chute plate 148. The chute plate 148 can be slightly thinner than the thickness of a coin. A dispensed coin imparts kinetic energy to the first buffering body 166 when the dispensed coin strikes the first buffering unit 136. The kinetic energy imparted to the first buffering body 166 is dissipated in friction during the subsequent swinging motion.

A coin turning body 168 is plate-like in shape and can be located at a guiding groove 162C in relation to the first buffering body 166, for example. The coin turning body 168 is slanted at about 70 degrees from horizontal. When the edge of a dispensed coin from coin hopper 112C strikes the coin turning body 168 at an obtuse angle, the coin turns over and strikes the first buffering body 166. The force (kinetic energy) of the dispensed coin is reduced by striking the first buffering body 166 and the coin is guided towards the chute plate 148 by the lower end of the first buffering body 166. In this manner, the dispensed coin slides down the chute plate 148 in contact with the plane, and rolling of the coin on an edge down the chute plate 148 can be avoided.

In reference to FIG. 5, the buffering units 136 associated with coin hoppers 112E-112H are shown and explained. Second buffering units 170 have a similar structure as the first buffering body 166 and are located at the upper chute sections 140E-140H and in proximity to the back row 124B. The upper end of the second buffering body 174 is plate-like in shape and extends across the upper chute 140F. The second buffering body 174 can pivot on a second shaft 172 that is attached at the upper end section of the upper separating wall 160.

The second shaft 172 is positioned horizontally and crosses the dispensing direction of the coins from the coin hopper 112F at a right angle. A second buffering body 174 slightly slants in a standby condition. The lower end section of the second buffering body 174 and the second slanting section 152 are located in close proximity, as shown in FIG. 5. The edge of a coin that is dispensed from a coin hopper on the rear row 124B, such as from coin hopper 112F for example, strikes the second buffering body 174 at approximately a right angle. The energy of the dispensed coin is somewhat dissipated by the collision with the second buffering body 174 and the dispensed coin is directed towards the second slanting section 152 by the lower end of the second buffering body 174. The dispensed coin slides down on the second slanting section 152 in contact with the plane. Following this, the dispensed coin slides down on the chute plate 148 also in contact with the plane. In this manner, rolling of the dispensed coin is avoided.

Motion of the dispensed coin from coin hoppers 112A-112D from the front row 124F is explained in reference to FIG. 6. The dispensed coins are dispensed from dispensing slots 126F and pass through elongated holes 157 into the upper chute unit 144. The dispensed coins travel in a parabolic arc in a downward direction as they are dispensed due to the effect of a constant gravitational force. In this manner, the edge of a dispensed coin collides with the coin turning body 168 at an obtuse angle causing the coin to flip end over end so that the obverse of the coin turns to the reverse and the reverse has contact with the chute plate 148.

When the dispensed coin collides with the first buffering body 166, the falling energy is somewhat absorbed and the dispensed coin is guided by the lower ends of the first buffering body 166. In this manner, the dispensed coins from the front row 124F maintain contact with the planar surface of the chute plate 148 and rolling is minimized while the dispensed coins slide down under the force of gravity. The sliding coins collide with the concave sections 190 of the upper cover 192 at an acute angle.

The energy of the sliding coins is somewhat absorbed due to the flexibility of the somewhat resilient resinous material causing the dispensed coins to fall in a level manner into the associated coin storing section 14. The falling coin then comes to rest in a level manner at the bottom portion of the storing section 14. If the storing section already contains a quantity of dispensed coins, the newly dispensed coin comes to rest upon the level stack of dispensed coins. As a result, the dispensed coins are reliably stacked in a level manner and coins falling edgewise down the storing section 14, or coming to rest in a vertical manner, are avoided.

Similarly, motion of the dispensed coin from coin hoppers 112E-112H from the back row 124B is explained in reference to FIG. 5. The dispensed coins are dispensed from dispensing slots 126B and pass through elongated holes 157 into the upper chute unit 144. The dispensed coins collide with the second buffering body 174 at an acute angle. As a result, the second buffering body 174 is pivoted in the clockwise direction and the kinetic energy of the dispensed coin is somewhat absorbed.

A coin that has collided with the second buffering body 174 is turned downwards since the angle of incidence is acute. As a result, the reverse surface of the dispensed coin has contact with the second slanting section 152 since the coin is guided towards the second slanting section 152 by the lower end of the second buffering body 174. In this manner, the dispensed coins from the back row 124F slide down and have planar contact with the chute plate 148 as they are guided by the lower side walls 160 towards the coin storing section 14. Once the dispensed coin reaches the coin storing section, it falls in a level manner to be accumulated as discussed above.

Figure 7:
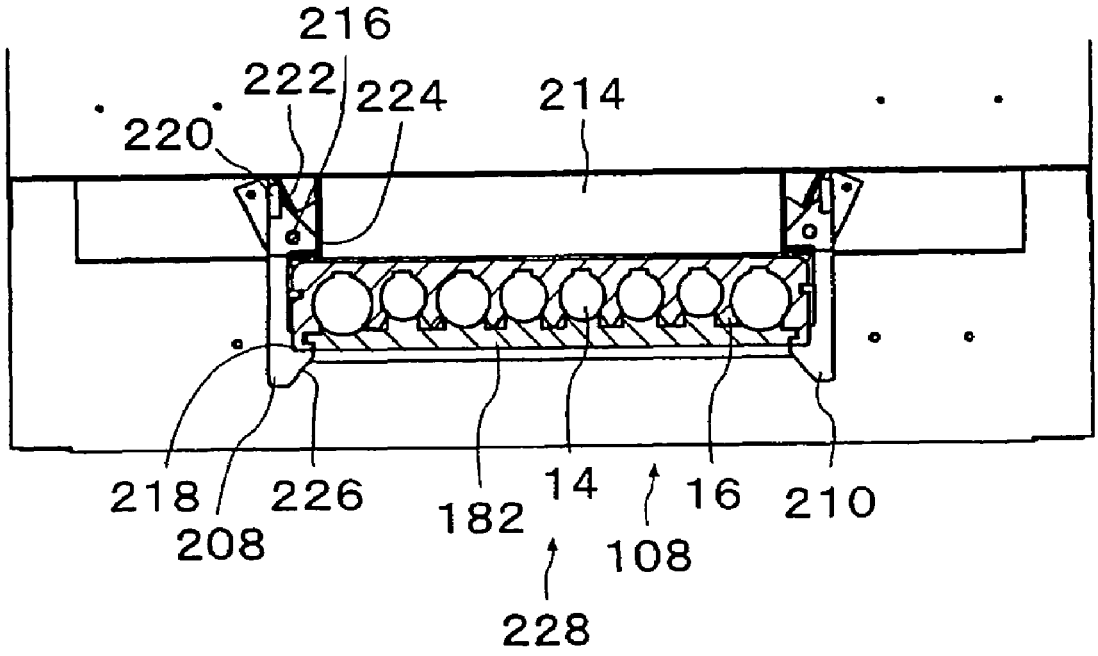
FIG. 7 is a cross-sectional view along the C-C line as shown in FIG. 4 in accordance with an embodiment of the present invention.
Figure 8:
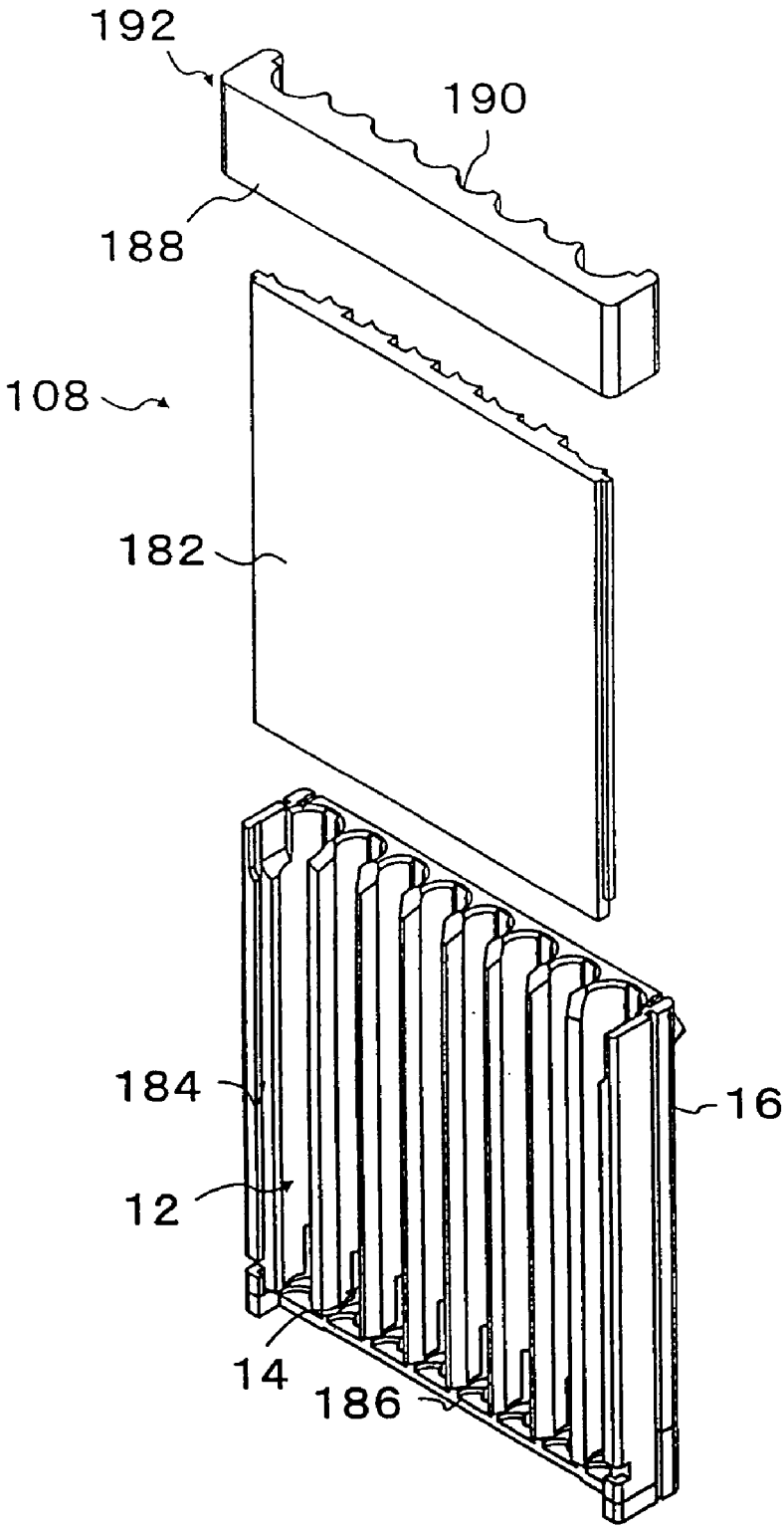
FIG. 8 is a perspective view of the auxiliary cover in accordance with an embodiment of the present invention.

In reference to FIGS. 7 and 8, the coin storing unit 108 is shown and explained. The coin storing unit 108 includes a storing unit body 16, a first auxiliary cover 182 and an upper cover 192. The storing unit body 16 includes a plurality of storing sections 14 for accumulating dispensed coin according to their denominations. The first auxiliary cover 182 is a plate-like member having left and right ends that can be inserted into sliding grooves 184 of the storing unit body 16. The storing unit body 16 itself, without the sliding grooves 184, is known in the art, and is combined in a novel way with the new elements as a part of the embodiment. The first auxiliary cover 182 encloses the side openings 12 without enclosing the lower opening 186.

An upper cover 192 includes a front side wall 188 which is positioned on the same side as the side openings 12 and extends upwards above the storing unit body 16 and includes a plurality of concave sections 190 that are aligned with each of the plurality of storing sections 14. The upper cover 192 can be composed of an inexpensive resin material.

In reference to FIGS. 5 and 6, the lower portion of the coin storing unit 108 is positioned between a lower cover 194 and a rear wall 202. The lower cover 194 is fixed at an upward facing concave section 200 of a position controller 198 and affixed to the base 196. In this manner, the coin storing unit 108 position is determined and the lower opening 186 is enclosed by the lower cover 194.

A rear wall of the storing unit body 16 is adjacent to an elongated lower supporter 206 that is affixed to a perpendicular wall 204 on the base 196 in order to determine the position of the lower section of the storing unit body 16. A middle section of the storing unit body 16 is held on the left and right side by moving holders 208 and 210 respectively, as shown in FIG. 7. The moving holders 208 and 210 have the same construction and are located symmetrically facing each other to releasably grasp the coin storing unit 108 positioned between them. This described structure comprises a holding section so that the coin storing unit 108 is held at a predetermined position.

In reference to FIGS. 6 and 7, a middle supporter 214 is rectangular in shape and is affixed near the midpoint of the perpendicular wall 204. The middle supporter 214 has contact with a rear wall of the storing unit body 16. The moving holder 208 pivots on a shaft 216 that extends upwards at the side of the middle supporter 214. A hook 218 is located at the end of the moving holder 208 and holds the storing unit body 16 left side from a frontal position. A leaf spring 222 is attached to a portion of the moving holder 208 in order to urge the moving holder in a counter clockwise direction. The moving holder 208 has a stopper 224 for contacting a left side of the middle supporter 214 in order to stop the rotation urged by the leaf spring 222.

The coin storing unit 108 is preferably mounted by moving the coin storing unit 108 perpendicularly towards the middle supporter 214 with the coin storing unit 108 tilted slightly so that the lower section of the coin storing body 16 is positioned between the lower cover 194 and the lower supporter 206 at the upward facing concave section 200. From this position, the coin storing unit 108 is rotated to an upright position so that the back portion of the coin storing body 16, on the side away from the side opening 12, is positioned against the middle supporter 214. During this maneuver, a left rear corner of the coin storing body 16 has contact with a slanting surface 226 of the left moving holder 208 which pivots the left moving holder 208 in a clockwise direction.

Similarly, a right rear corner of the coin storing body 16 has contact with a slanting surface 226 of the right moving holder 210 which pivots the right moving holder 210 in a counter clockwise direction. As the coin storing body 16 continues this movement, the hook 218 of the left moving holder 208 and a corresponding hook on the right moving holder 210 approach engagement with the front wall of the coin storing body covered by the first auxiliary cover 182. Once the back portion of the coin storing body 16 contacts the middle supporter 214 the hooks of the left and right moving holders (208, 210) are pivoted towards each other in order to grasp the coin storing unit 108 in the proper position.

In this manner, the upper portions of the plurality of storing sections 14 are located in a position under the lower sections of the guiding grooves 162A-162H. The upper openings 18 of the storing sections 14 are located adjacent to a lower section 205 of the chute plate 148, as shown in FIGS. 5 and 6. When the coin storing unit 108 is disposed in the supplying position 228 the moving holders (208, 210) are urged to rotate towards each other and may be assisted by the hand of a user so that the hooks 218 are positioned around the frontal portion of the coin storing unit 108.

Figure 10:
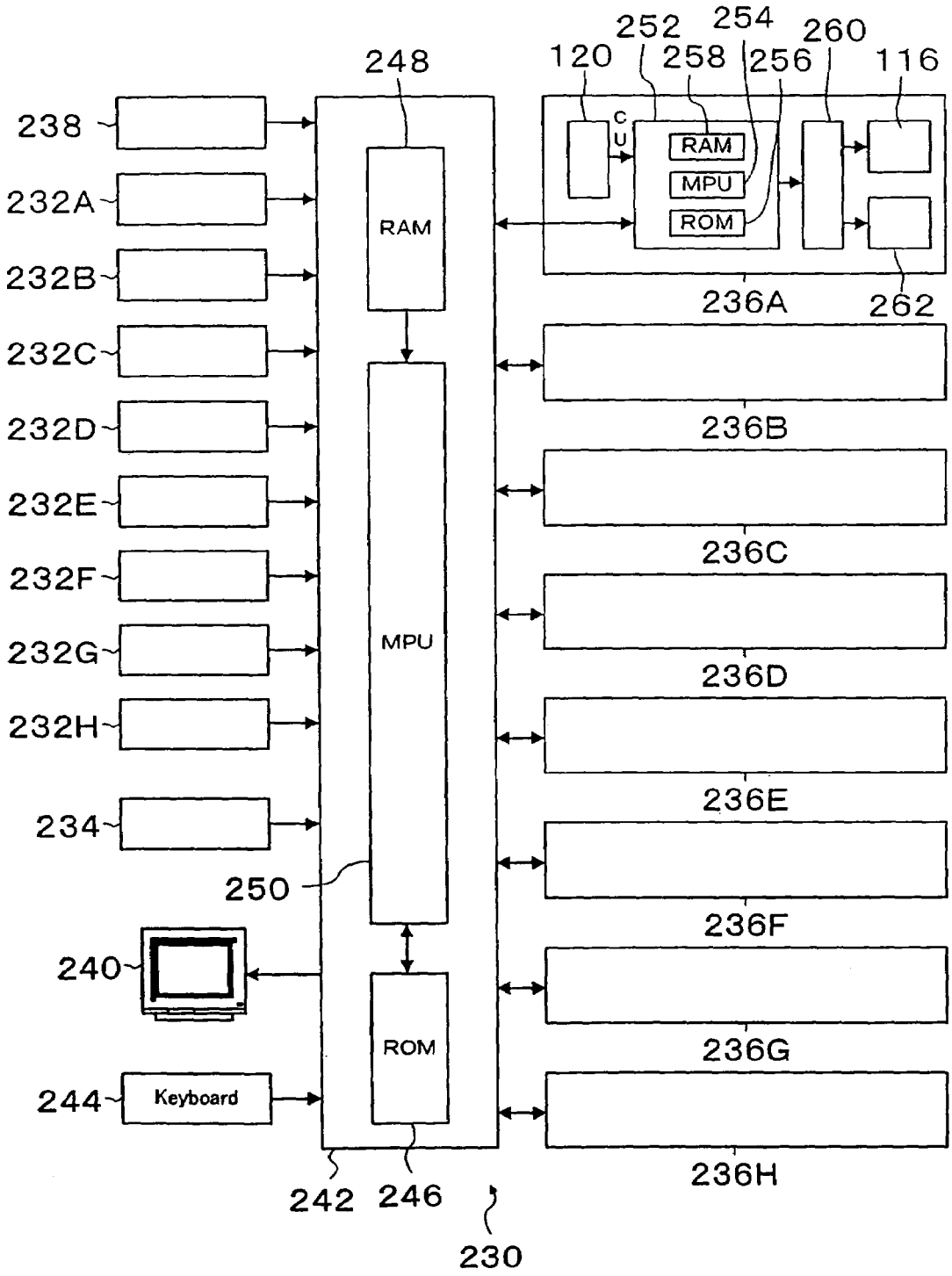
FIG. 10 is a block diagram showing a control unit and a coin hopper controller in accordance with an embodiment of the present invention.
Figure 11:
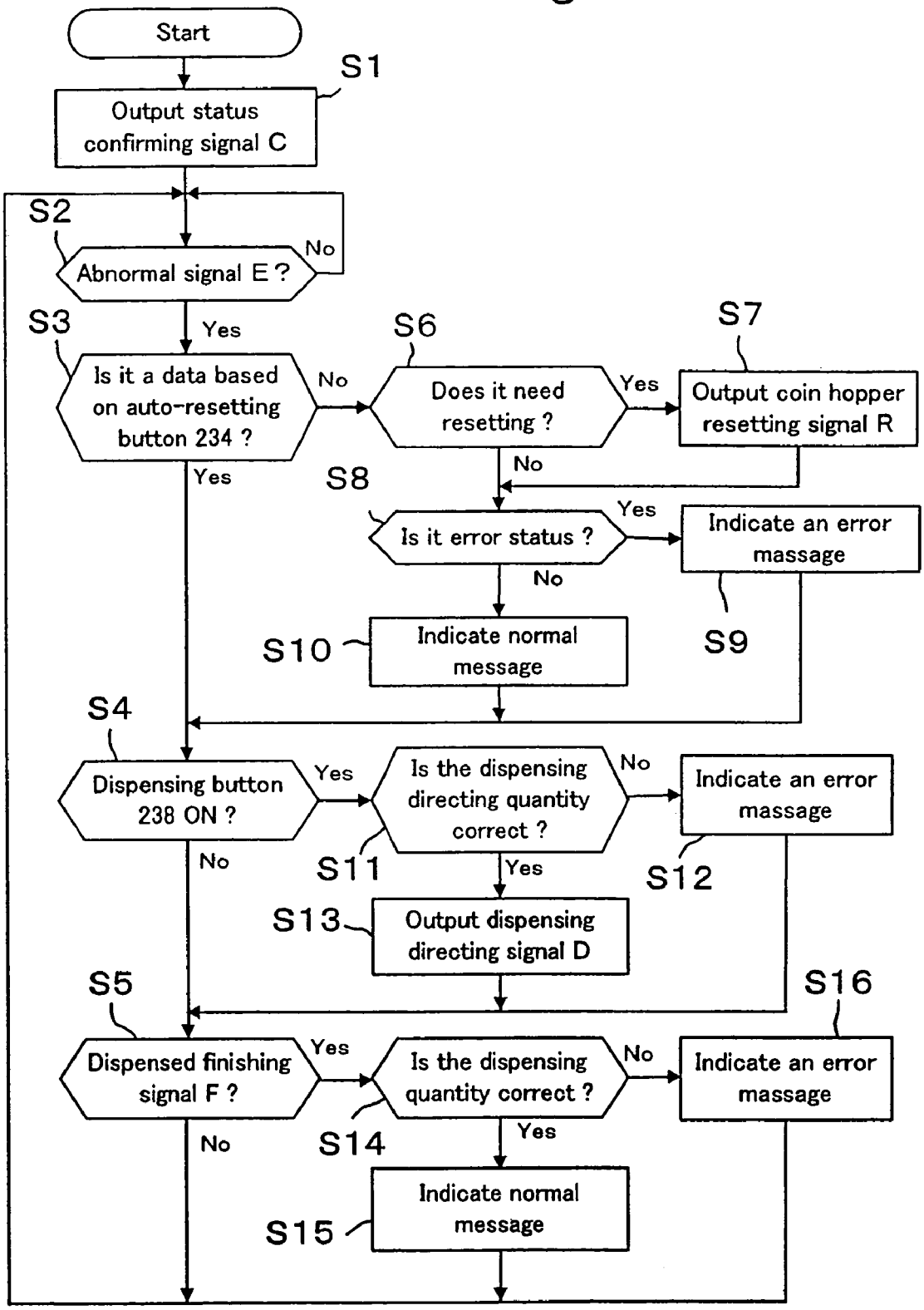
FIG. 11 is a flow diagram showing the operation of a dispensing processing unit in accordance with an embodiment of the present invention.
Figure 12:
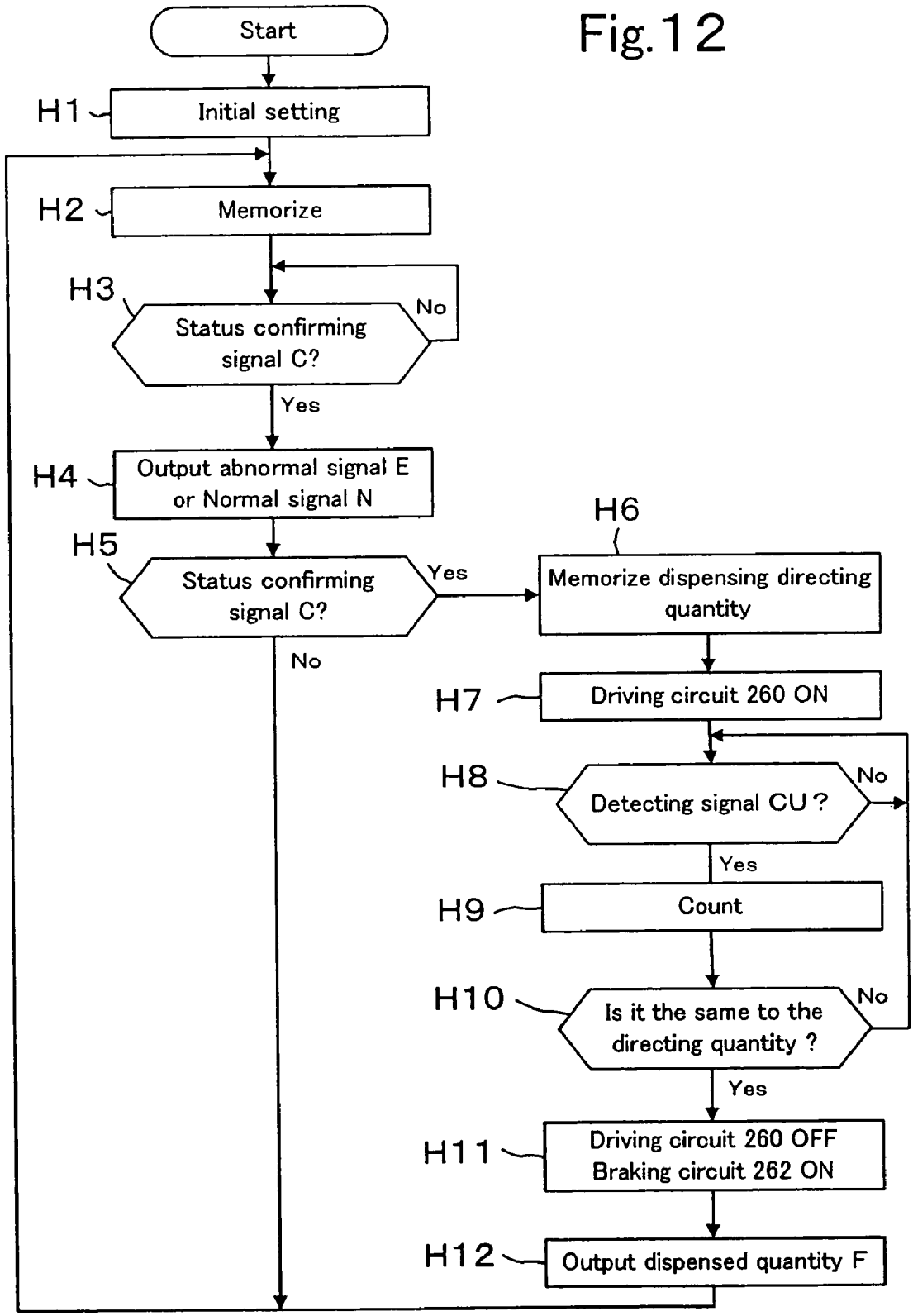
FIG. 12 is a flow diagram showing the operation of a coin hopper processing unit in accordance with an embodiment of the present invention.

In reference to FIGS. 10-12, a dispensing control unit 230 for controlling the dispensing of coins from the plurality of coin hoppers 112A-112H is shown and explained. The dispensing control unit 230 controls each of the plurality of coin hoppers 112A-112H in order to dispense from each of the coin hoppers 112 a predetermined quantity of coins based on predetermined settings, transient conditions, and the actuation of various user controls. The quantity of coins dispensed by each of the plurality of coin hoppers 112 can be different. Alternatively, for some or all of the coin hoppers 112, the number of dispensed coins can be equal.

The dispensing control unit 230 includes a plurality of setting units 232A-232H, an automatic reset button 234, a dispensing button 238, a user display 240, and a dispensing processing unit 242. Each setting unit 232 determines the dispensing quantity of its associated coin hopper 112 with reference 232A identifying the "No. 1 hopper dispensing quantity setting circuit", and reference 232H identifying the "No. 8 hopper dispensing quantity setting circuit" so that the setting units 232A-232H correspond with hopper numbers 1-8 respectively. The automatic reset button 234 and the dispensing button 238 can be switches that are selectively activated by a user. The user display 240 can indicate to a user the status of the automatic coin aligning apparatus showing either a normal condition or an abnormal or error condition exists. This display can include colors, text, and graphics to communicate the current status to a user.

The dispensing processing unit 242 can receive signals from the setting units 232A-232H, the automatic resetting button 234, the dispensing button 238, and the keyboard 244, and output signals to the coin hopper control units 236A-236H and the display unit 240. The keyboard unit 244 may be continuously connected to the dispensing processing unit 242 or may be temporarily connected for use during maintenance or when loading new programming information, for example. The dispensing processing unit 242 includes a Microprocessor Unit (MPU) 250 such as a programmable microprocessor, a Read Only Memory (ROM) 246, and a Random Access Memory (RAM) 248.

The MPU 250 executes a program stored in the ROM 246 and can read and write intermediate data to the RAM 248. Each of the coin hopper dispensing quantity setting circuits 232 can be implemented as one or more memory locations so that a dispensing quantity is determined by examining the contents of one or more predetermined memory locations. Alternatively, the coin hopper processing unit 242 can be implemented with a logic circuit or an execution unit for executing a program in a file format instead of a programmable processor.

Each coin hopper 112 includes a coin hopper control unit 236 for receiving control signals from the dispensing processing unit 242 and operating the coin hopper 112 in order to dispense the required quantity of coins. Each coin hopper control unit 236 includes a sensor unit 120 for detecting a coin dispensed by the coin hopper 112 and outputting a coin detection signal CU. Each coin hopper control unit 236 includes a coin hopper processing unit 252 having a Microprocessor Unit (MPU) 254 such as a programmable microprocessor, a Read Only Memory (ROM) 256, and a Random Access Memory (RAM) 258. It is understood that the ROM 246 and ROM 256 can include a programmable ROM (PROM), an Ultra-Violet PROM (UVPROM), an Electrically Erasable PROM (EEPROM), or other configurable memory unit that is designed to be read from during normal, in-circuit operations but may be altered under certain special conditions. The MPU 254 executes a program stored in the ROM 256 and can read and write intermediate data to the RAM 258.

Alternatively, the coin hopper processing unit 252 can be implemented with a logic circuit or an execution unit for executing a program in a file format instead of a programmable processor. The coin hopper processing unit 252 asserts a control signal to a driving circuit 260 that will send a motor control signal to a motor unit 116 and a brake control signal to a braking circuit 262. The motor control signal activates or deactivates the motor unit 116 that operates the rotating disk 118. The brake control signal activates or deactivates the braking circuit 262 to more precisely control the rotation of the rotating disk 118.

Each coin hopper processing unit 252 receives control signals from the dispensing processing unit 242 and the coin hopper sensor unit 120 associated with the particular coin hopper 112 where the coin hopper processing unit 252 resides. Each coin hopper control unit 236 also returns status information to the dispensing processing unit 242 indicating whether or not the required number of coins have been properly dispensed or to indicate an error condition. An error condition can include dispensing an improper amount of coins, or not resetting from an error condition, for example.

Actuating the automatic reset button 234 causes each of a plurality coin hopper control units 236A-236H to be reset to an idle state where coins are not dispensed. When the dispensing button 238 is actuated by a user the coin hopper control units 236A-236H begin dispensing coins according to their preprogrammed parameters and any user inputs. The processing unit 242 detects the actuation of the dispensing button and asserts a signal to the predetermined coin hopper control units 236 causing them to start dispensing coins according to the program stored in their ROM 256 and current conditions. This program can determine whether or not a particular coin hopper 112 is activated, and if so how many coins are dispensed. If a coin hopper 112 is activated, the associated motor 116 is activated and coins in the associated coin hopper bowl 114 are dispensed in a one by one manner.

Once the predetermined number of coins are dispensed as sensed by the sensor unit 120, the driving circuit 260 deactivates the motor 116 and activates the braking circuit 262 in order to stop the rotation of the rotating disk 118. This causes the rotating disk to stop promptly and ensures an additional coin is not erroneously dispensed. Where two or more coin hoppers 112 dispense the same denomination, a single control signal may be asserted from the dispensing processing unit 242 to the same denomination coin hoppers 112. For example, the 1-cent coin hoppers (112B, 112C, and 112F) can all receive the same control signal indicating the command to dispense a predetermined quantity of 1-cent coins. In this case, only a single coin hopper dispensing quantity setting unit 232B may be used, simplifying the programming and hardware requirements for the present invention.

As an initial condition of the dispensing control unit 230, the dispensing quantities of the coin hopper dispensing setting circuits 232 are each preset to a predetermined value. For example, a default quantity of 100 coins could be set into each coin hopper dispensing quantity setting circuit. The default quantity can be changed by entering a change to the program or else by changing the contents of the memory locations storing the dispensing quantity for a particular coin hopper 112. In this case, the keyboard can be used to enter a change to the program or the memory data in a dispensing quantity setting mode which is different from the normal operational mode of the dispensing control unit 230. Alternatively, the dispensing quantity can be changed by incorporating the contents of a file into either the RAM or ROM memories.

In reference to FIGS. 11 and 12, the operation of the automatic coin dispensing and aligning apparatus 100 is shown and explained in terms of the operation of the dispensing control unit 230 and one of the plurality of coin hopper control units 236. When the automatic reset button 234 is actuated the dispensing processing unit 242 then enters an "Output Status Confirming Signal C" step S1 and communicates with each of the coin hopper processing units 252 causing each of them to enter their "Initial Setting" step H1. The coin hopper processing units 252 are reset in step H1 and control passes within the coin hopper control unit 236 to a "Memorize" step H2. If an abnormal or error condition is detected, an abnormal signal E is stored in step H2. Conversely if a normal condition is detected, a normal signal N is stored in step H2. Following a reset caused by actuation of the automatic reset button 234, the coin hopper control unit 236 will store an abnormal signal E. Once either the signal E or the signal N is stored, control passes within the coin hopper control unit 236 to a "Status Confirming Signal C?" step H3.

In step H3 the presence of the signal C from the dispensing processing unit 242 is detected. The coin hopper processing unit 252 will remain in step H3 until the signal C is detected from the dispensing processing unit 242. Once the signal C is detected, control passes within the coin hopper processing unit 252 to an "Output Abnormal Signal E or Normal Signal N" step H4.

In step H4 the signal (either E or N) stored in step H2 is asserted to the dispensing processing unit 242 and control passes within the coin hopper processing unit 252 to a "Dispensing Signal D?" step H5.

In step H5, a dispensing direction signal D is detected from the dispensing processing unit 242. The dispensing direction signal D is a command to dispense the predetermined quantity of coins from the coin hopper 112 receiving the signal D. If the dispensing signal D is not detected, control passes within the coin hopper processing unit 252 to step H2. If the dispensing signal D is detected, control passes within the coin hopper processing unit 252 to a "Memorize Dispensing Directing Quantity" step H6.

After entering the "Output Status Confirming Signal C" step S1, control passes within the dispensing processing unit 242 to an "Abnormal Signal E or Normal Signal N?" step S2 where either an abnormal signal E or a normal signal N is detected as asserted by the coin hopper processing units 252. Once one of the status situation signals E or N are detected, control within the dispensing processing unit 242 passes to a "Is It A Data Based On Auto-resetting Button 234?" step S3.

In step S3, if the abnormal signal E is due to the actuation of the automatic reset button 234, control passes within the dispensing processing unit 242 to a "Dispensing Button 238 ON" step S4 since this is a normal condition following actuation of the automatic reset button 234. However, in step S3, if the abnormal signal E is not due to the actuation of the automatic reset button 234, control passes within the dispensing processing unit 242 to a "Does It Need Resetting?" step S6.

In step S4, actuation of the dispensing button 238 is detected. If the actuation of the dispensing button 238 is detected, then the dispensing processing unit 242 proceeds with the dispensing process described in reference to step H5 above and control within the dispensing processing unit 242 passes to an "Is The Dispensing Directing Quantity Correct?" step S11. Conversely, if the actuation of the dispensing button 238 is not detected, then the dispensing processing unit 242 proceeds with the detecting of a dispensing finished signal F and control within the dispensing processing unit 242 passes to in a "Dispensed Finishing Signal F?" step S5.

In step S5, if the dispensing finished signal F is detected then the coin hopper 112 is indicating it has finished dispensing a quantity of coins and control passes within the dispensing processing unit 242 to an "Is The Dispensing Quantity Correct?" step S14. Conversely, if the dispensing finished signal F is not detected then the coin hopper 112 is not indicating it has finished dispensing a quantity of coins and control passes within the dispensing processing unit 242 back to "Abnormal Signal E or Normal Signal N?" step S2. Thus, following a reset condition, the dispensing processing unit 242 will continuously loop through step S2 ->step S3 ->step S4 ->step S5 repeating until activation of the dispensing button 238 is detected, the dispensing finished signal F is detected, or until an abnormal signal E that is not due to the actuation of the automatic reset button 234 is detected.

In step S6, an abnormal signal E has been detected that is not due to the actuation of the automatic reset button 234. In this step, a determination is made whether the abnormal signal E needs to be reset. This can occur in a variety of settings, and includes the condition where a coin hopper 112 is erroneously indicating an abnormal condition when none exists. In this case, it may be desirable to mask off this abnormal signal E so as not to interfere with the operation of the other coin hoppers 112. If the abnormal signal E needs to be reset, control within the dispensing processing unit 242 passes to an "Output Coin Hopper Resetting Signal R" step S7. If the abnormal signal E does not need to be reset, control within the dispensing processing unit 242 passes to an "Is It Error Status?" step S8.

In step S7, a coin hopper reset signal R is asserted to a coin hopper 112 that asserted an abnormal signal E that is not due to the actuation of the reset button 234 causing the coin hopper 112 to reset itself, and control within the dispensing processing unit 242 passes to step S8.

In step S8, if the abnormal signal E is again detected. If the abnormal signal E is still present, control within the dispensing processing unit 242 passes to an "Indicate An Error Message" step S9. If the abnormal signal E is no longer present, control within the dispensing processing unit 242 passes to an "Indicate A Normal Message" step S10.

In step S9, an error message is asserted to the display 240 and processing within the dispensing processing unit 242 halts to indicate service is needed. Actuation of the reset button 234 will place the dispensing processing unit 242 into an initial state S1.

In step S10, a normal (non-error) message is asserted to the display 240 and control within the dispensing processing unit 242 passes to step S5.

In step S11, actuation of the dispensing button 238 has been detected and a determination is made as to whether the dispensing directing quantity is correct. If the dispensing directing quantity is not correct, control within the dispensing processing unit 242 passes to an "Indicate An Error Message" step S12. If the dispensing directing quantity is correct, control within the dispensing processing unit 242 passes to an "Output Dispensing Directing Signal D" step S13.

In step S12, the dispensing directing quantity is not correct and an error message is asserted to the display 240 and processing within the dispensing processing unit 242 halts to indicate service is needed. Actuation of the reset button 234 will place the dispensing processing unit 242 into an initial state S1.

In step S13, the dispensing quantity is determined to be correct and the dispensing directing signal D is asserted to the selected coin hopper 112. Once the dispensing directing signal D is asserted, control within the dispensing processing unit 242 passes to step S5. Returning to the state of the coin hopper processing unit 252, when the dispensing signal D is detected, control passes to step H6.

In step H6, the coin hopper processing unit 252 stores a dispensing directing quantity and control passes to a "Driving Circuit 260 ON" step H7.

In step H7, the driving circuit 260 is activated so that the motor 116 is activated causing the rotating disk 118 to begin rotating and control passes to a "Detecting Signal CU?" step H8.

In step H8, coins are dispensed by the rotating disk 118 in a one by one manner. The sensor unit 120 detects each coin as it is dispensed and outputs a detecting signal CU. If a dispensed coin is not detected, control remains in step H8 waiting for the signal CU. If a dispensed coin is detected, control passes to a "Count" step H9.

In step H9, the count of the signal CU is accumulated with a previous dispensing count value to indicate a current dispensing count value and control passes to an "Is It The Same To The Directing quantity?" step H10. The previous dispensing count value is initialized to a value of zero prior to the first accumulation.

In step H10, the current dispensing count value is compared with the dispensing directing quantity. If the current dispensing count value is the same as the dispensing directing quantity, then the correct number of coins have been dispensed and control passes to a "Driving Circuit 260 OFF Braking Circuit 262 ON" step H11. Conversely, if the current dispensing count value is not the same as the dispensing directing quantity, then the correct number of coins have not yet been dispensed and control returns to step H7 to await subsequent coin dispensing signals CU.

In step H11, the driving circuit 260 disables the motor 116 and enables the braking circuit 262 so that the rotation of the rotating dispensing disk 118 will stop promptly so that no more coins will be dispensed. Control then passes to an "Output Dispensed Quantity F" step H12.

In step H12, the dispensed finishing signal F is asserted to the dispensing processing unit 242 and control passes within the coin hopper processing unit 252 to step H2. All coin hopper control units 236A-236H will behave the same under normal conditions except for the possibility of counting a different number of dispensed coins.

Returning to the dispensing processing unit 242, in step S14, the dispensing finished signal F has been detected and a determination is made whether the dispensing quantity is correct. If the dispensing quantity is not correct, control within the dispensing processing unit 242 passes to an "Indicate An Error Message" step S16. Conversely, if the dispensing quantity is correct, control within the dispensing processing unit 242 passes to an "Indicate Normal Message" step S15.

In step S15, a normal (non-error) message is asserted to the display 240 and control within the dispensing processing unit 242 passes to step S2.

In step S16, the dispensing quantity is not correct and an error message is asserted to the display 240 and processing within the dispensing processing unit 242 halts to indicate service is needed. Actuation of the reset button 234 will place the dispensing processing unit 242 into an initial state S1.

At this point, the dispensing of the coins has finished and the moving holders (208, 210) may be pivoted so that the coin storing unit 108 can be removed from the holding section 109 and the coin storing unit 108 removed from the coin aligning apparatus 100.

Figure 26:
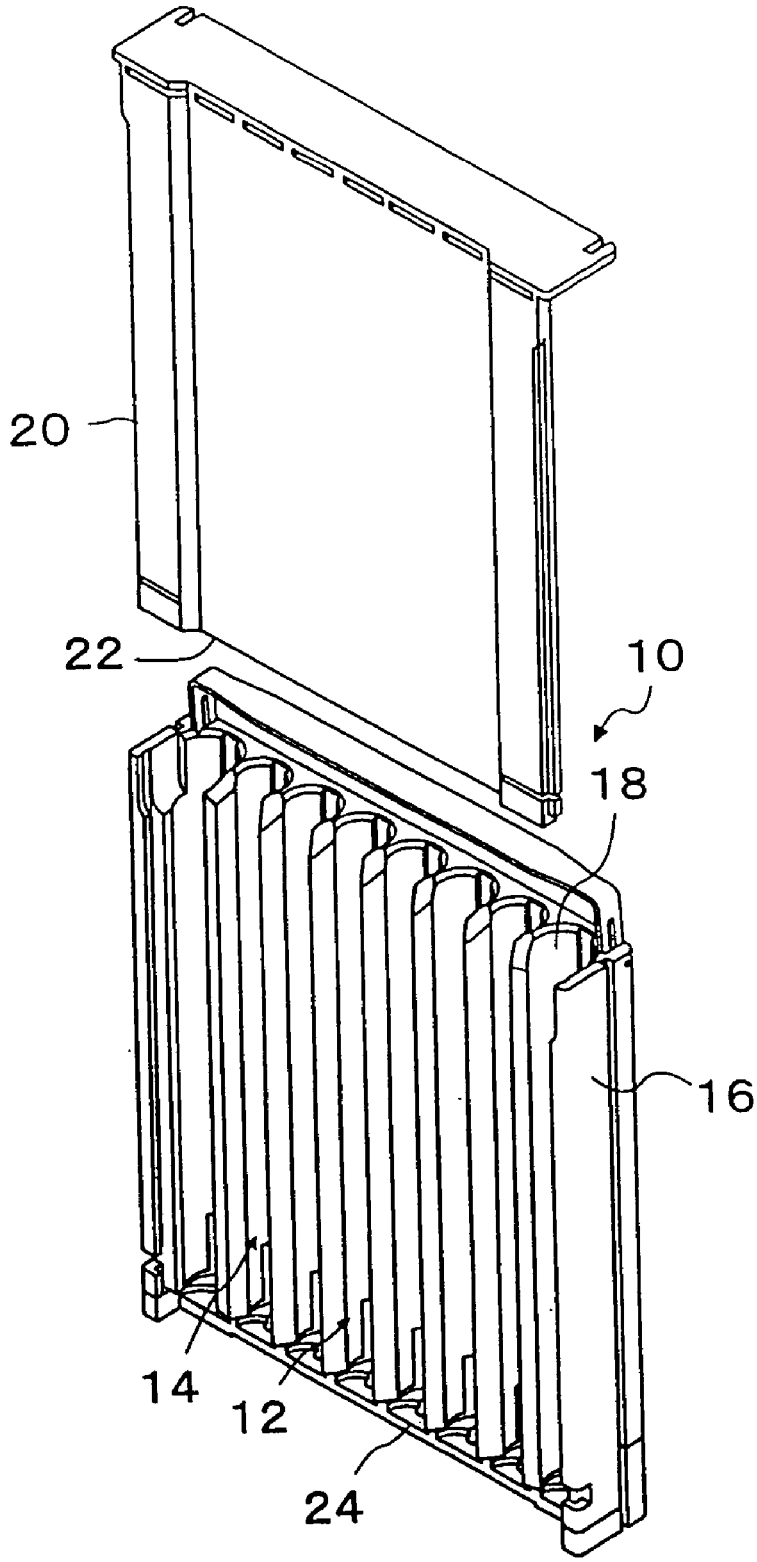
FIG. 26 is a perspective view showing a conventional coin storing body cover for sliding onto a conventional coin storing body.

In reference to FIG. 8, once the coin storing unit 108 is loaded with predetermined quantity of coins according to their denomination through the previously described procedure, the auxiliary cover 182 can be removed from the coin storing body 16 and replaced with a coin storing body cover 22 by sliding the edges of the coin storing body cover 22 within the sliding grooves 184 as described above, and now as shown in FIG. 26. Once the coin storing body cover 22 is mounted on the coin storing body 16 containing the stacked coins, the coin storing body 16 supplied with coins may be used in a coin dispensing system.

In reference to FIGS. 13-18, another embodiment of the present invention is shown and explained. A coin aligning apparatus 300 includes a coin hopper section 304, a chute section 306, and a coin storing section 308. The coin hopper section 304 includes a plurality of coin hoppers 312A-312H for storing coins of each denomination in bulk and dispensing coins in a one by one manner. The chute section 306 is located at a position below the coin hopper section 304 and serves to guide the dispensed coins as they slide down the chute section 306. The coin storing section 308 is located at a position below the chute section 306 in order to receive the sliding coins from the chute section 306.

The coin hopper section 304 and the chute section 306 are located within a box-like enclosure 302. A holding section 309 is oriented on the front face of the enclosure 302 adjacent to an opening 310 on the front wall of the enclosure 302. The holding section 309 is slidable and located adjacent the opening 310 so the coin aligning apparatus 300 is compact.

Figure 16:
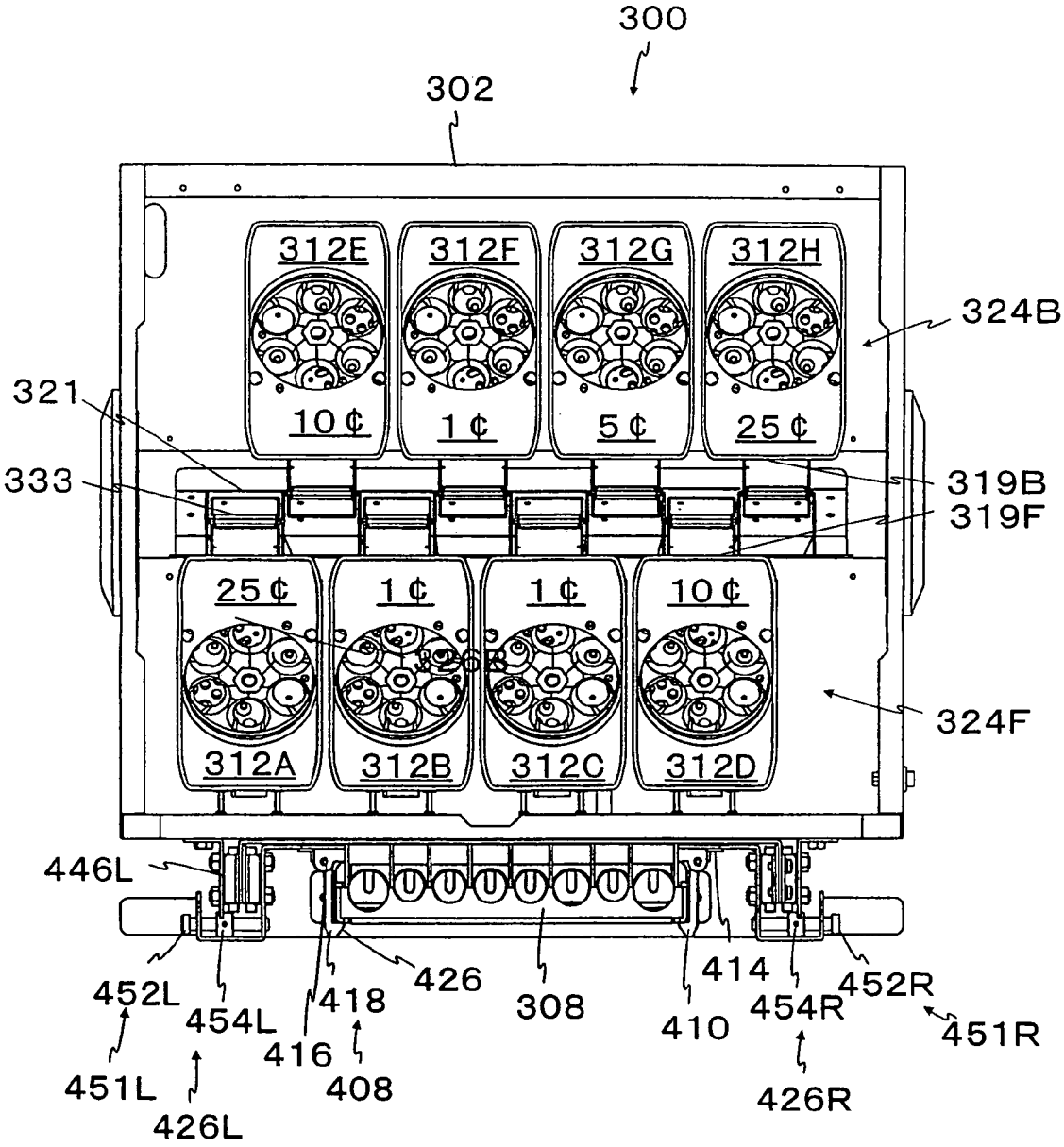
FIG. 16 is a top planar view of the automatic coin aligning apparatus with the upper lid removed in accordance with an embodiment of the present invention.

In reference to FIG. 16, the structure of the coin hopper section 304 is shown and explained. The coin hopper section 304 includes at least four coin hoppers 312 which can correspond to at least four different coin denominations. These coin hoppers 312 are located in the coin hopper section 304 and each one stores the coins in bulk according to their denomination and each dispenses coins in a one by one manner. The four different denominations can be United States minted coins in 25-cent, 10-cent, 5-cent, and 1-cent denominations, but coins of other origin and denominations may also be used.

An embodiment of the automatic coin aligning apparatus includes eight coin hoppers 312A-312H so that each denomination has two coin hoppers 312. For example, coin hopper 312A and 312H correspond to 25-cent denomination coins, coin hoppers 312D and 312E correspond to 10-cent denomination coins, coin hopper 312G corresponds to 5-cent denomination coins, and coin hoppers 312B, 312C, and 312F correspond to 1-cent denomination coins. All eight coin hoppers 312 include a rectangular bowl 314 for storing the particular coins in bulk, a rotating disk 318 rotated by an electric motor 316 located at the bottom of the bowl 314, and a coin sensor 320 located at a dispensing slot.

Alternatively, a coin hopper 312 not including a rotating disk 318 may be used. The coin hoppers 312A-312H can include either a left frame 311L or a right frame 311R and are located opposite each other in parallel at a predetermined distance in an array format. Each coin hopper 312 has a dispensing slot 319 which is opened to the side of a circular aperture 315 within an upward facing base 313. A coin sensor 320 is located beside the dispensing slot 319 and detects a coin as it is dispensed from the coin hopper 312.

A duct 321 is channel-like in shape and faces toward the dispensing slot 319 to form a guiding passageway 317 that extends perpendicularly. The duct 321 is detachably affixed to either a left frame 311L or a right frame 311R. A wall of the duct 321 extends continuously down to contact a base 313 and includes a first slanting surface 323 which extends down at a first angle from a side of the dispensing slot 319, a second slanting surface 325 which extends down at a second angle that is larger than the first angle from the first slanting surface 323, and a first perpendicular surface 327 that extends perpendicularly.

A second perpendicular surface 329 is located facing the first perpendicular surface 327 and positioned at a distance about three to five times the thickness of a dispensed coin. The distance between the first perpendicular surface 327 and the second perpendicular surface 329 defines the cross-sectional height of the duct 321 at a falling opening 331 located at the lower section between the first perpendicular surface 327 and the second perpendicular surface 329. The cross-sectional width of the duct 321 at the falling opening 331 is approximately half the width of the coin hopper 312, as shown in FIG. 16. The width is smaller than twice the diameter of the largest dispensed coin and preferably smaller than 1.5 times the diameter of the largest dispensed coin. In this manner, the coin hopper 312 and the duct 321 correspond and are combined.

Figure 18:
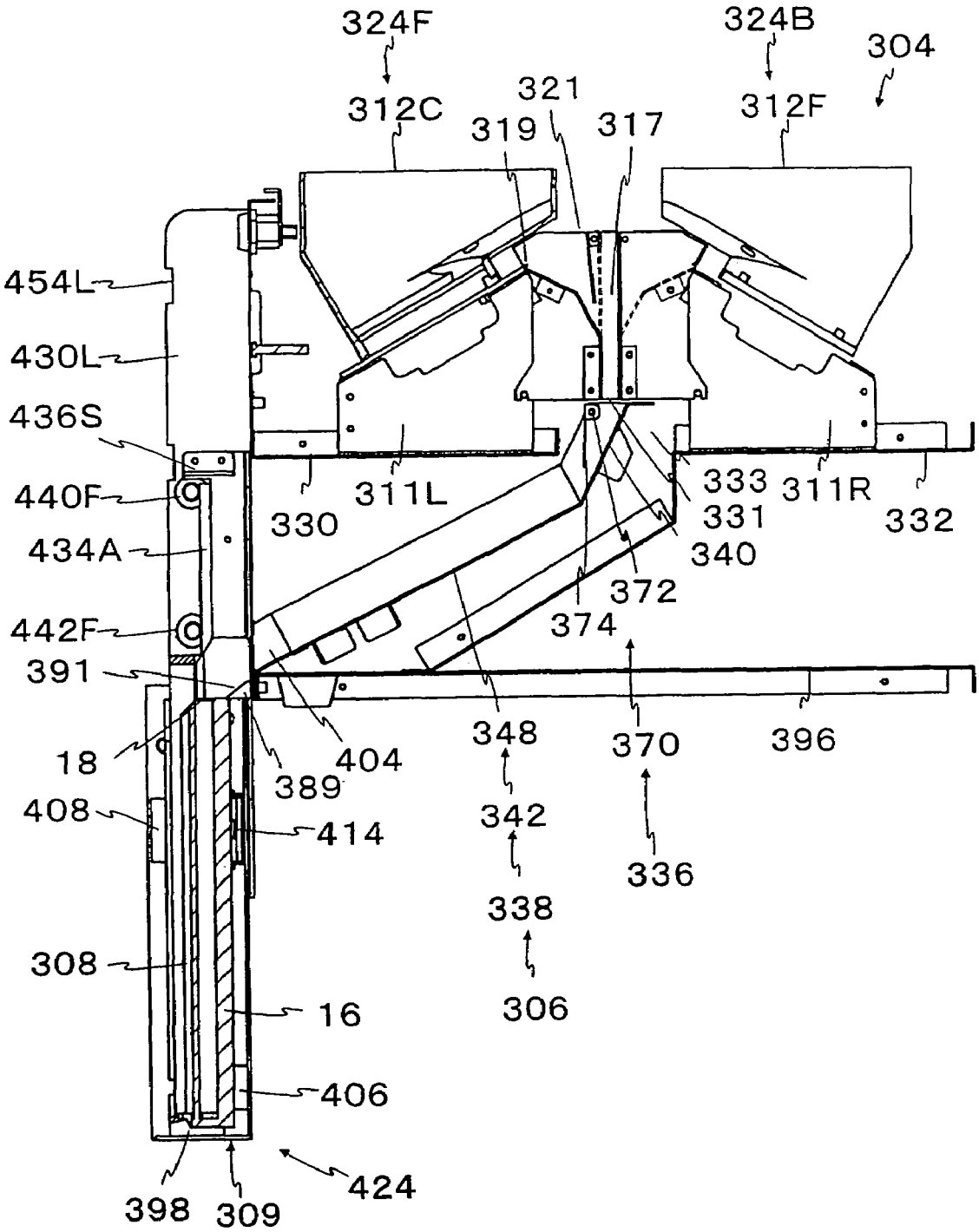
FIG. 18 is a cross-sectional view along the line A-A as shown in FIG. 15 in accordance with an embodiment of the present invention.

Dispensing slots 319F associated with a front row 324F and dispensing slots 319B associated with a rear row 324B are located facing each other and offset from each other in a staggered formation as shown in FIG. 16. In this manner, the ducts 321 of adjoining coin hoppers 312 are adjacent so that the guiding passageways 317 are aligned along a single line above entrances to the top section of the chute 306, as shown in FIG. 18. Due to this overlapping design, the width and depth of the enclosure 302 are smaller allowing for a more compact implementation and a simpler construction of the chute section 306.

Similar to another embodiment, a suitable coin hopper 312 is described by U.S. Pat. No. 5,562,536 to Uchida et al. and U.S. Pat. No. 6,193,599 to Kurosawa et al. The rotating disks 318 described in these patents include four or more through holes. In this case, the coins may be dispensed too quickly which can prevent the proper accumulation of coins above the rotating disk 318. To address this issue, a motor speed reducer 316MR is placed between a motor 316 and the rotating disk 318 to slow down the dispensing rate of the coin hopper 312 and permit the dispensed coins to be aligned by a less complex and costly apparatus.

Figure 13:
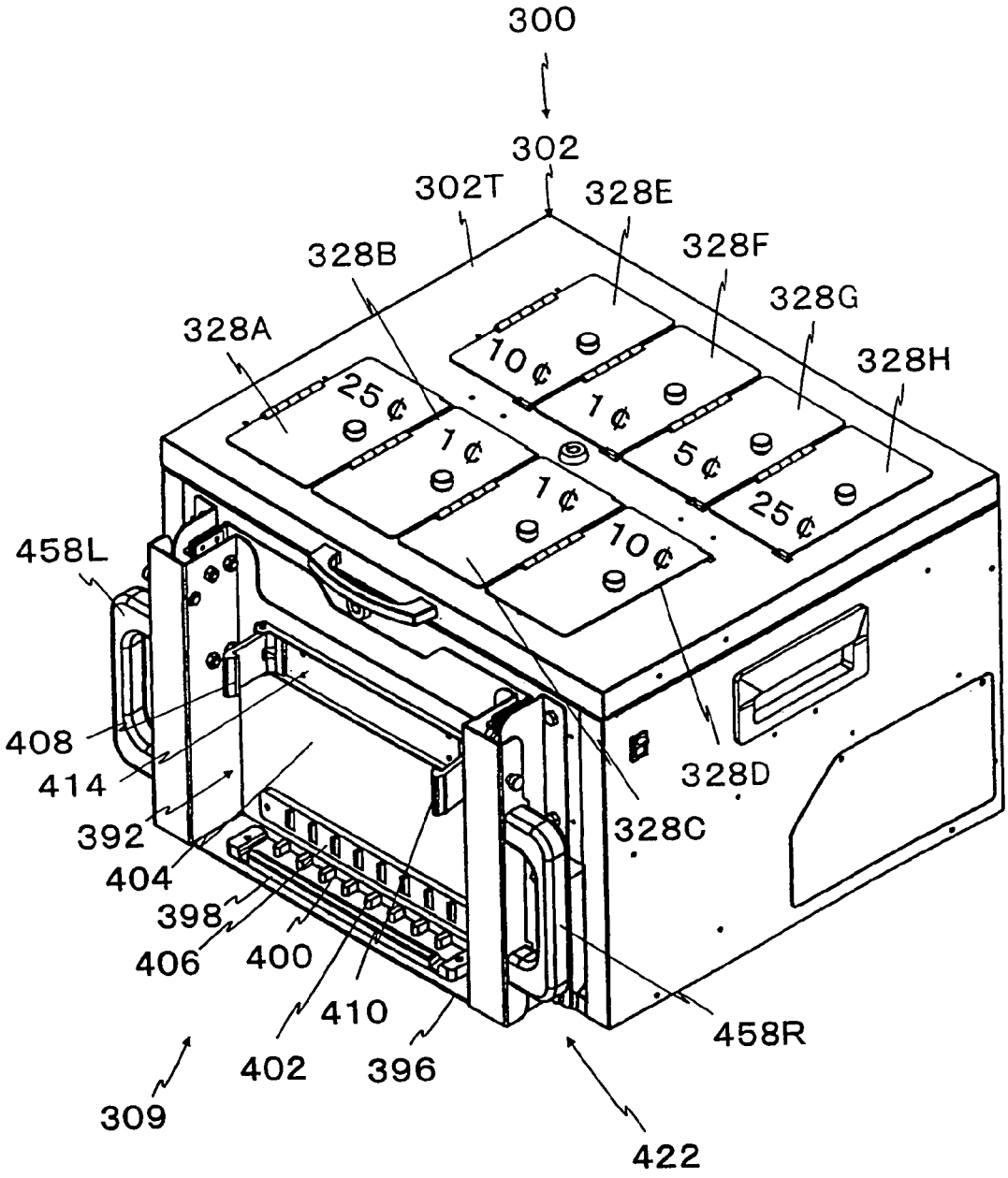
FIG. 13 is a perspective view of an automatic coin aligning apparatus in a standby condition in accordance with an embodiment of the present invention.
Figure 14:
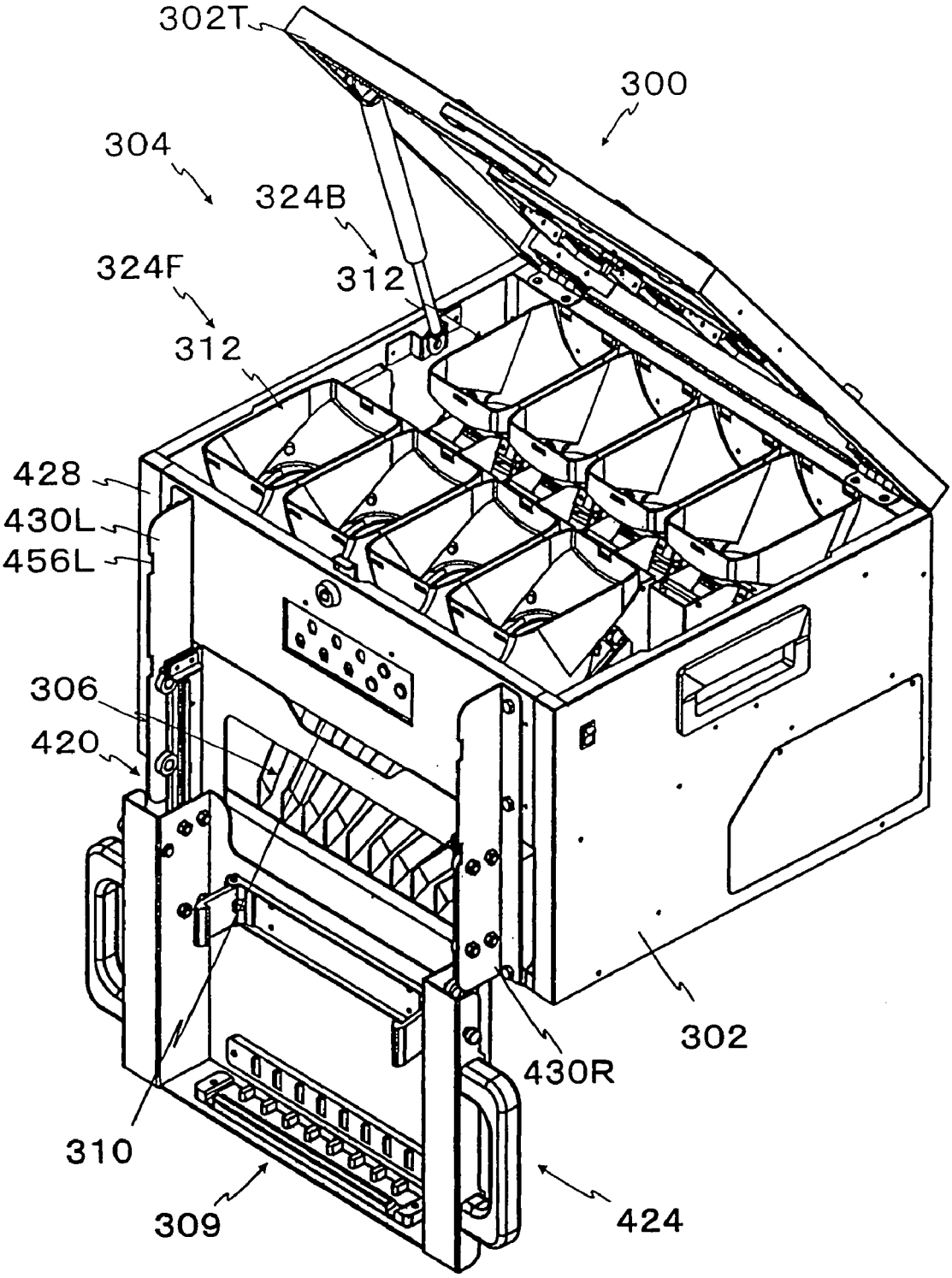
FIG. 14 is a perspective view showing the condition where the upper lid is opened and the storing section is moved to the supplying position in accordance with an embodiment of the present invention.

In reference to FIGS. 13 and 14, lids 328A-328H are located at the top board 302T of the enclosure 302 for adding coins to each coin hopper 312. The lids 328A-328H can pivot to open and are located over the upper openings of the bulk storing bowls 314 to allow individual access to each of the coin hoppers 312. The enclosure top 302T is affixed to the enclosure 302 along one edge and can pivot to open in order to provide access to all of the coin hoppers 312 simultaneously.

The coin hoppers 312A-312D of the front row 324F can be affixed to a first base 330 located in the upper section of the box-like enclosure 302 and oriented horizontally in a level manner. Similarly, the coin hoppers 312E-312H of the back row 324B can be fixed to a second base 332 located in the upper section of the box-like enclosure 302 and oriented horizontally in a level manner. The second base 332 is mounted on an upper section of a base 396.

In reference to FIG. 18, the chute section 306 is shown and explained. The chute section 306 is located under the dispensing slots 319F and 319B of the coin hopers 312. The chute section 306 is operative to guide dispensed coins from the coin hoppers 312 as the dispensed coins slide down a predetermined chute section toward an associated coin storing section 14 of the coin storing unit 308. The chute section 306 includes ducts 321, buffering units 336, and a sliding section 338 for receiving the coins dispensed by the coin hoppers 312 and guiding the received coins as they slide down by gravity along a chute plate 348 in a lower chute section 342 of the chute section 306. The chute section 306 includes upper chute sections 340 denoted as upper portions and a lower chute sections 342 denoted as lower portions. The upper chute sections 340 have a funnel-shaped cross-section and are located between the front row 324F and the back row 324B for ease of maintenance. The upper chute sections 340 together form the upper chute unit 344.

Figure 17:
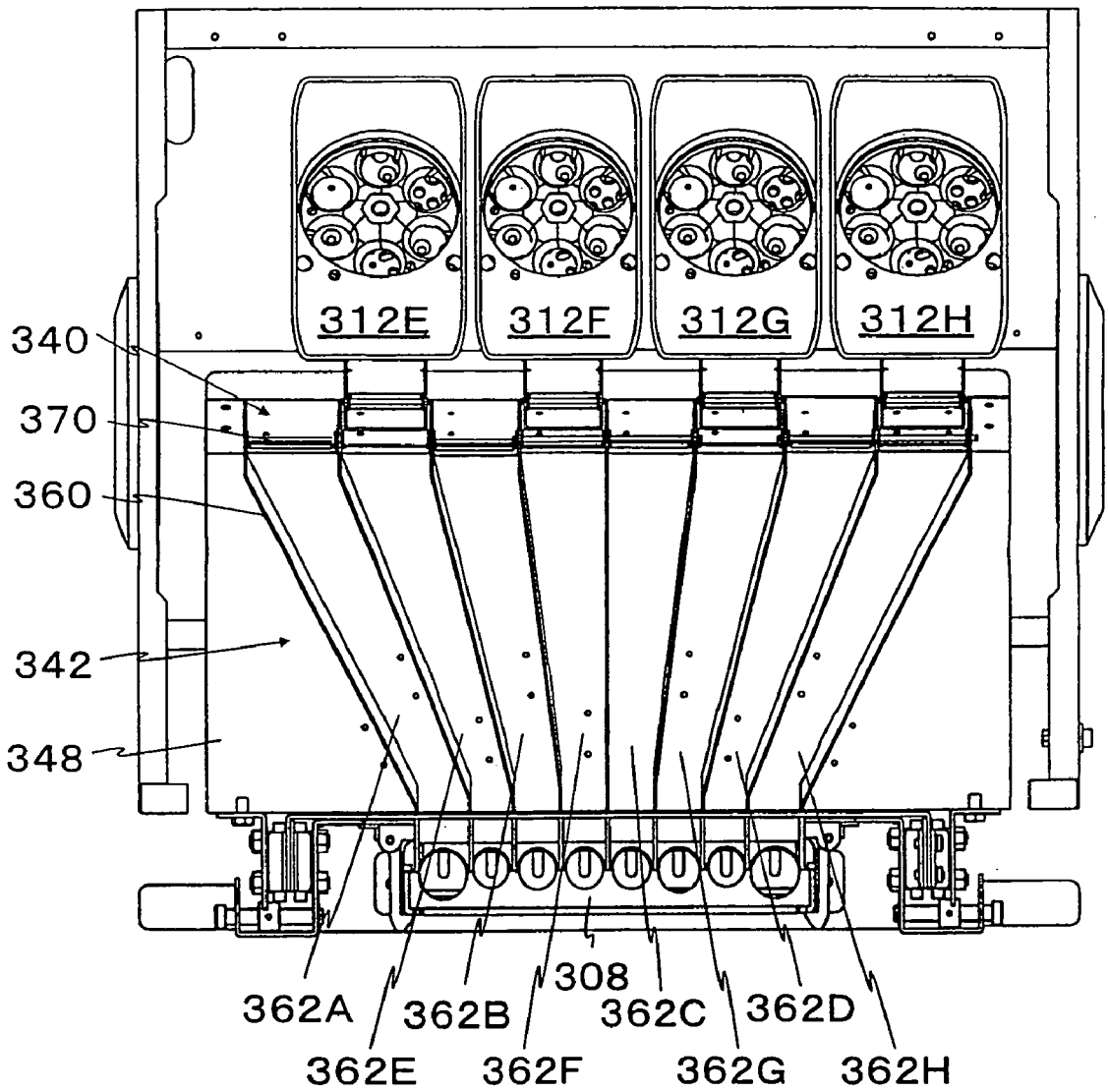
FIG. 17 is a top planar view showing the chute section of the automatic coin aligning apparatus in accordance with an embodiment of the present invention.

In reference to FIG. 18, the sliding section 338 includes an upper chute section 340 that slants at a predetermined first angle and a lower chute section 342 that slants at a second angle that is smaller than the first angle. The upper chute section 340 is located below the falling slots 331 which are located between the front row 324F and the back row 324B. The upper chute section 340 is separated into eight sections defining guiding grooves 362A-362H and may be denoted as chute channels 362, each chute channel 362 corresponding to one of the eight coin hoppers 312. The eight sections are formed by the chute plate 348 and separating walls 360 which are fixed perpendicularly upon the chute plate 348 at a predetermined distance to define the eight guiding grooves as passageways which extend perpendicularly along the chute plate 348, as shown in FIGS. 2 and 17. The upper portion of the upper chute section 340 is located under the falling slot 331 of duct 321 and has the same width and depth as the falling slot 331 so as to receive dispensed coins from the falling slot 331.

The chute plate 348 can slant at an angle of between about 20 degrees to about 40 degrees as measured from the horizontal, but preferably slants at about 25 degrees. When the slanting angle is greater than 40 degrees, the sliding speed of the coins on the chute plate 348 can be too fast and the dispensed coins may not be properly accumulated. Conversely, when the slanting less than about 20 degrees the sliding speed of the coins on the chute plate 348 can be too slow, and some coins may stop sliding on the chute plate 348. The upper end of the chute channels 362 are positioned to correspond with the upper chute 340 in order to receive coins from the associated coin hopper 312. The lower portions of the chute channels 362 are located over corresponding storing sections 14 in the storing unit 308. In reference to FIG. 17, the guiding grooves (362A, 362E, 362B, 362F, 362C, 362G, 362D, 362H) are located symmetrically to the center of the chute plate 348 lower section 342.

Figure 19:
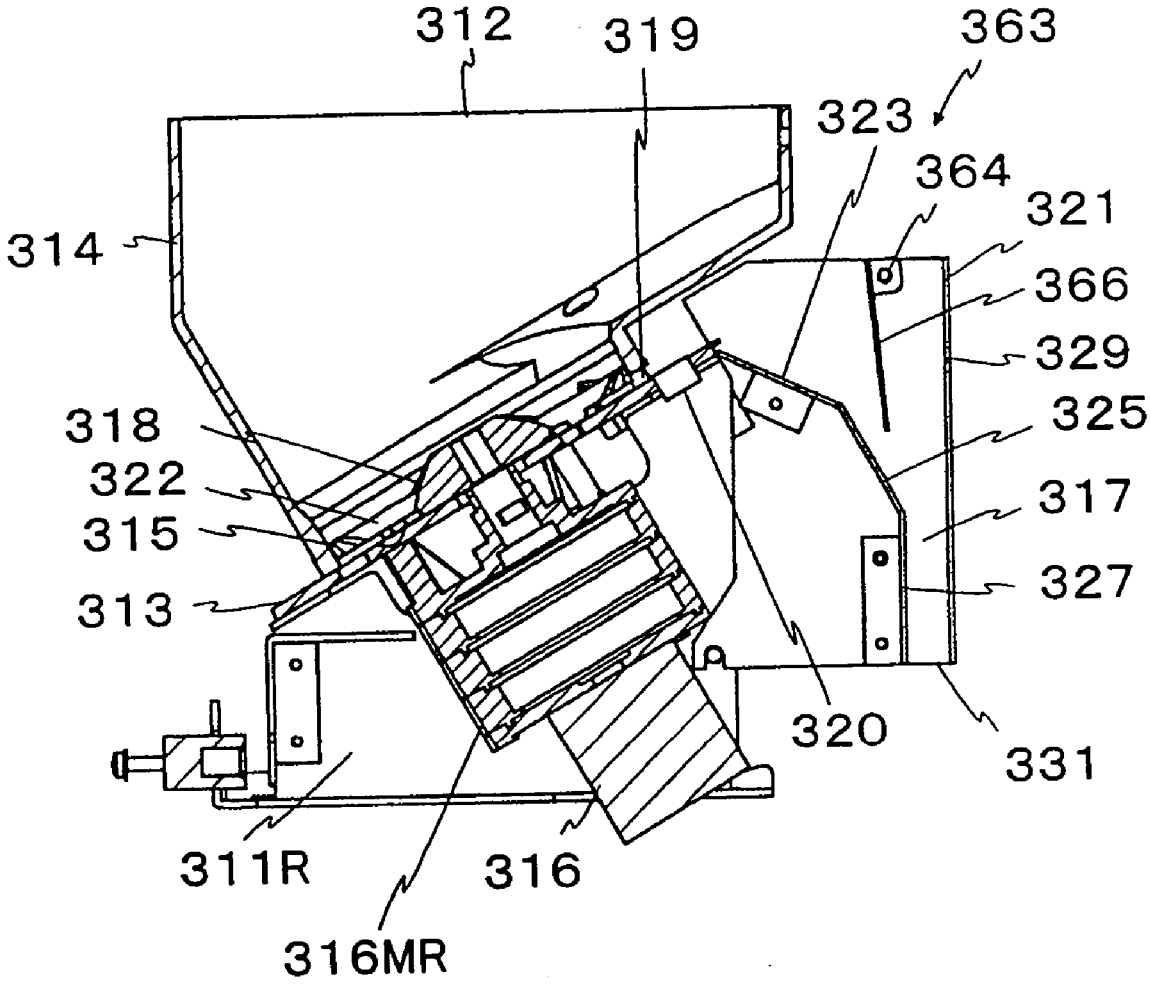
FIG. 19 is a longitudinal cross-sectional view at the centerline of a rotating disk of a coin hopper in accordance with an embodiment of the present invention.

In reference to FIG. 19, first buffering units 336 are explained. The first buffering units 363 are located within the upper sections of the guiding passageways 317 and are operable to reduce or absorb a portion of the kinetic energy or force-due-to-motion of a dispensed coin to facilitate the proper sliding of the coins along the chute section 306 and collecting of the dispensed coins in the appropriate storing section 14 in the coin storing section 308. The first buffering unit 363 includes a first buffering body 366 which is plate-like in shape and extends across the guiding passageway 317.

The first buffering body 366 pivots on a first shaft 364 that is located at the upper section of the duct 321. The first shaft 364 is level and crosses at a right angle to the dispensing direction of the coins from the associated coin hopper 312. The plate-like structure of the first buffering body 366 is suspended from one side of the shaft 364 and can pivot describing a swinging motion along the direction of travel of the dispensed coin through the guiding passageway 317. In an idle state, the first buffering body 366 is slanted from vertical so that a lower end of the plate-like structure is displaced away from the second slanting surface a distance corresponding to approximately the thickness of a dispensed coin. This is desirable in order to deflect incident coins dispensed from the coin hopper 312 onto a downward path. A dispensed coin imparts kinetic energy to the first buffering body 366 when the dispensed coin strikes the first buffering unit 363. The kinetic energy imparted to the first buffering body 366 is dissipated in friction during the subsequent swinging motion.

As a coin is dispensed by a coin hopper 312 it moves in an upwards trajectory initially because base 313 slants upwards at an angle with the dispensing slot 319 ejecting a dispensed coin at an angle in a slightly upwards direction. The dispensed coin follows a parabolic trajectory upwards and then downwards prior to colliding with a portion of the first buffering body 366. Therefore the force of the dispensed coin is reduced as it is deflected towards the second slanting surface 325 by the lower end of first buffering body 366, and it slides down on a portion of the second slanting surface 325. Afterwards the coin collides with a second perpendicular surface 329 in an obtuse angle. Upon colliding with a portion of the second perpendicular surface, the coin is turned downwards in the direction of the guiding passageway 317.

In reference to FIG. 18, a second buffering unit 370 is shown and described. The second buffering units 370 are located at each guiding grooves 362A-362H of the upper chute section 340. The second buffering units 370 have a similar structure and include a second buffering body 374 having a plate-like structure that crosses the associated guiding groove 362, and can pivot on a second shaft 372 which is attached at the upper section of separating wall 360. The second shaft 372 is level and crosses at a right angle to the dispensing direction of the coins from coin hopper 312.

The second buffering body 374 slightly slants in a normal condition under the force of gravity as shown in FIG. 18, and the lower end is displaced at a distance from the upper chute section 340 corresponding to the approximately the thickness of the dispensed coin. An edge of the dispensed coin collides with a portion of the upper chute section 340 and is deflected to the left off the upper chute section 340 to collide with a portion of the second buffering body 374. The falling coin is then deflected downward by the second buffering body 374 to fall onto the upper chute section 340 so that a top face or a bottom face of the dispensed coin is in face-to-face or planar contact as it slides down the chute plate 348.

In this manner, the kinetic energy or force of the coin is somewhat absorbed by these collisions while the dispensed coin is guided to a position of sliding on the chute section 342, and rolling is avoided. Thus, the coins movements are controlled and the dispensed coin moves toward the coin storing section 308 at a predetermined angle. The coin goes to coin storing section 308 at a predetermined angle. Alternatively, the second buffering unit may be omitted when the dampening effects of the first buffering unit 363 are sufficient to produce the controlled movement of a dispensed coin towards the coin storing section 308 as described.

Figure 20:
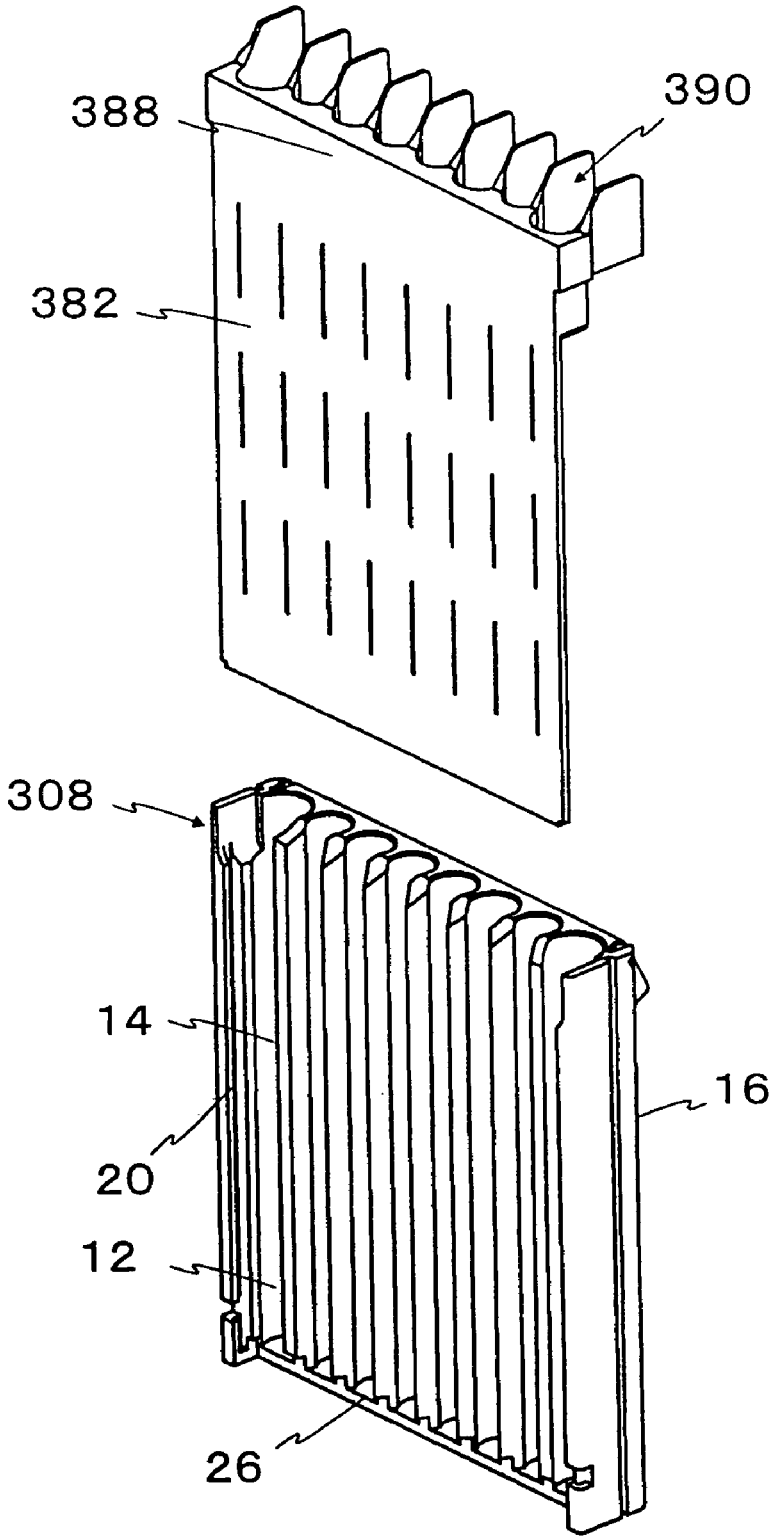
FIG. 20 is an exploded perspective view of the auxiliary cover of the storing unit in accordance with an embodiment of the present invention.

In reference to FIG. 20, the coin storing unit 308 is shown and described. The coin storing unit 308 includes a storing section 14 where the coins are accumulated according to their denominations. In this embodiment, an auxiliary cover 382 is a plate-like structure having left and right ends that are inserted into sliding grooves 20 (the right groove is not shown) of the storing unit body 16. The storing unit body 16 itself, without the sliding grooves 20, is known in the art, and is combined in a novel way with the new elements as a part of the embodiment. The auxiliary cover 382 encloses the side openings 12 without enclosing the lower opening 26 where coins may be dispensed. A side wall 388 portion is attached to the upper section of the auxiliary cover 382 extending upwards from the coin storing body 16 on the side of the side openings 12 and includes concave sections 390 extending above of each of the storing sections 14.

In reference to FIG. 18, a lower section of the side of the lower chute section 342 opposite the side wall 388 is bridged by a rib 389 which has a triangular cross section. The dispensed coin is guided by slanting surface 391 over rib 389, and falls into storing section 14. The integrated auxiliary cover 382 can be made from an inexpensive resinous material. The coin storing unit 308 is formed by the coin storing body 16 and the auxiliary cover 382. In this unified construction, the concave sections 390 are located over their corresponding storing sections 14 and form a continuous columnar shape. The coin storing unit 308 is fitted to a holding section 309 that is used to control the position of the coin storing unit 308 in relation to the chute section 306.

Figure 21:
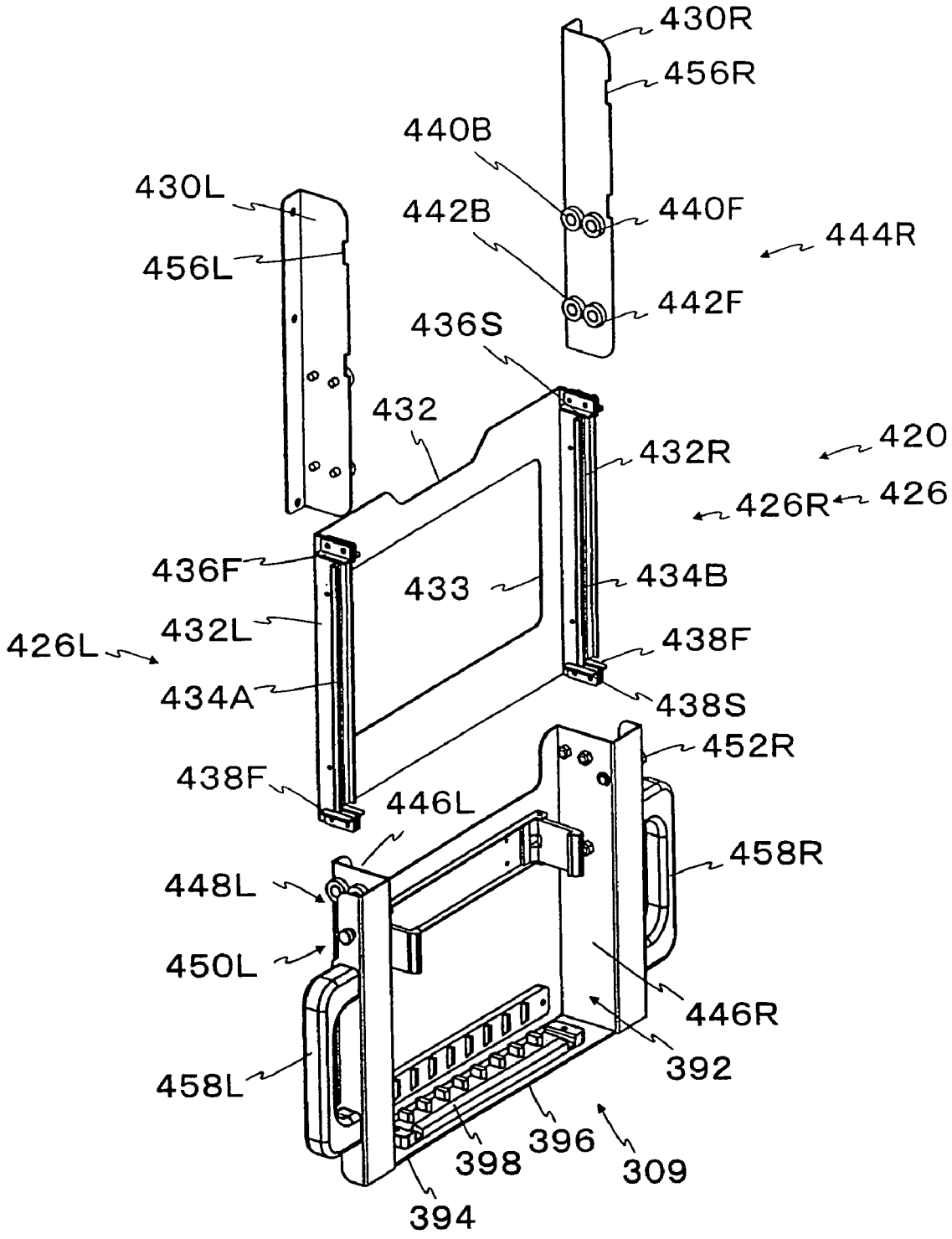
FIG. 21 is an exploded perspective view of a selecting attaching unit for the front side of an automatic coin aligning apparatus in accordance with an embodiment of the present invention.

In reference to FIGS. 13, 20, and 21, the holding section 309 is shown and described. The holding section 309 is operable to hold the coin storing unit 308 and to selectively position the coin storing unit 308 at either a standby position or a supplying position. The holding section 309 can be changed to another device that has the same function.

The holding section 309 includes a horizontal bottom 396 located at a lower section of a sliding base 394 of a rectangular concave section 392, a longitudinal wall 404, a position controller 398 of the coin storing unit 308, a lower supporter 406 and moving holders (408, 410). The position controller 398 is fixed at the horizontal bottom 396 and includes an upward facing concave section 400 and the rear wall 402. The lower end of the coin storing unit 308 is fitted between the upward facing concave section 400 and the rear wall 402 of the position controller 398. The lower opening 26 is enclosed by the position controller 398. This described structure comprises a holding section 309 so that the coin storing unit 308 is held at a predetermined position. A rear wall of the coin storing body 16 is fitted at the lower elongated supporter 406 and is fixed at a perpendicular wall 404 located adjacent to the sliding base 394 so the position of the lower section of the coin storing body 16 is determined.

In reference to FIG. 13, the moving holders 408, 410 are shown and explained. The moving holders (408, 410) are operable to grasp opposite sides of the coin storing unit 308 so that it is held at a predetermined position. The middle section of the coin storing body 16 is held by the moving holders (408, 410) at the left and right sides, respectively. The moving holders (408, 410) are symmetrical in shape, can be pivotable, and can be hook like in shape. A middle supporter 414 is rectangular in shape and is affixed near the middle of the perpendicular wall 404. The middle supporter 414 has contact with the rear wall of the coin storing body 16, and determines the front-to-back position of coin storing body 16.

In reference to FIG. 16, the moving holder 408 can pivot on a shaft 416 that extends vertically at the side of the middle supporter 414. A hook 418 can be located at the end of moving holder 408 for holding the body 16 from the front. A leaf spring (not shown) is hooked at the end of moving holder 408 so that the moving holder 408 can be urged in a counter clockwise direction. The moving holder 408 has a stopper 424 for contacting a left side of the middle supporter 414 in order to stop the rotation urged by the leaf spring 422.

When the coin storing unit 308 is preferably mounted by moving the coin storing unit 308 perpendicularly towards the middle supporter 414 with the coin storing unit 308 tilted slightly so that the lower section of the coin storing body 16 is positioned between the position controller 398 and the rear wall 402 which are located at concave section 400.

From this position, the coin storing unit 308 is rotated to an upright position so that the back portion of the coin storing body 16, on the side away from the side opening 12, is positioned against the middle supporter 414. During this maneuver, a left rear corner of the coin storing body 16 has contact with a slanting surface 426 of the left moving holder 408 which pivots the left moving holder 408 in a clockwise direction.

Similarly, a right rear corner of the coin storing body 16 has contact with a slanting surface 426 of the right moving holder 410 which pivots the right moving holder 410 in a counter clockwise direction. As the coin storing body 16 continues this movement, the hook 418 of the left moving holder 408 and a corresponding hook on the right moving holder 410 approach engagement with the front wall of the coin storing body 16 covered by the first auxiliary cover 382. Once the back portion of the coin storing body 16 contacts the middle supporter 414 the hooks of the left and right moving holders (408, 410) are pivoted towards each other in order to grasp the coin storing unit 308 in the proper position. As a result, the coin storing body 16 has contact with the middle supporter 414.

At this point, the upper portions of the storing sections 14 are located under the lower sections of the guiding grooves 362A-362H and the upper openings 18 of the storing sections 14 are located adjacent to and under the lower section 404 of the chute plate 348, as shown in FIG. 18. When the coin storing unit 308 is disposed in the supplying position 428 the moving holders (408, 410) are urged to rotate towards each other and may be assisted by the hand of a user so that the hooks 418 are positioned around the frontal portion of the coin storing unit 308 to securely hold the coin storing unit 308 at a predetermined position.

In reference to FIGS. 13, 14, and 21, a selective attaching unit 420 is shown and explained. The selective attaching unit 420 is operable to locate the holding section 309 in either a standby position 422 or a supplying position 424 through the movement of an expanding unit 426. The standby position 422 is an idle position where the holding section 309 is located in an upwardly translated position adjacent to the front side wall of the enclosure 302. Conversely, the supplying position 424 is an active position where the holding section is located in a downwardly translated position where the coin storing unit 308 is positioned to receive dispensed coins as described above. The operation of the expanding unit 426 allows the apparatus to present a more compact shape for movement and storage. Further, the holding section 309 cannot be misplaced as may occur if the holding section 309 was detached from the enclosure 302.

The selective positioning unit 420 is attached to the front portion of the enclosure 302 and is operable to selectively locate the coin storing unit 308 to a predetermined position located below the guiding grooves 362A-362F. In this manner, the holding section 309 is mounted upon the selective positioning unit 420 and is operable to selectively attach and detach the coin storing unit 308.

Figure 22:
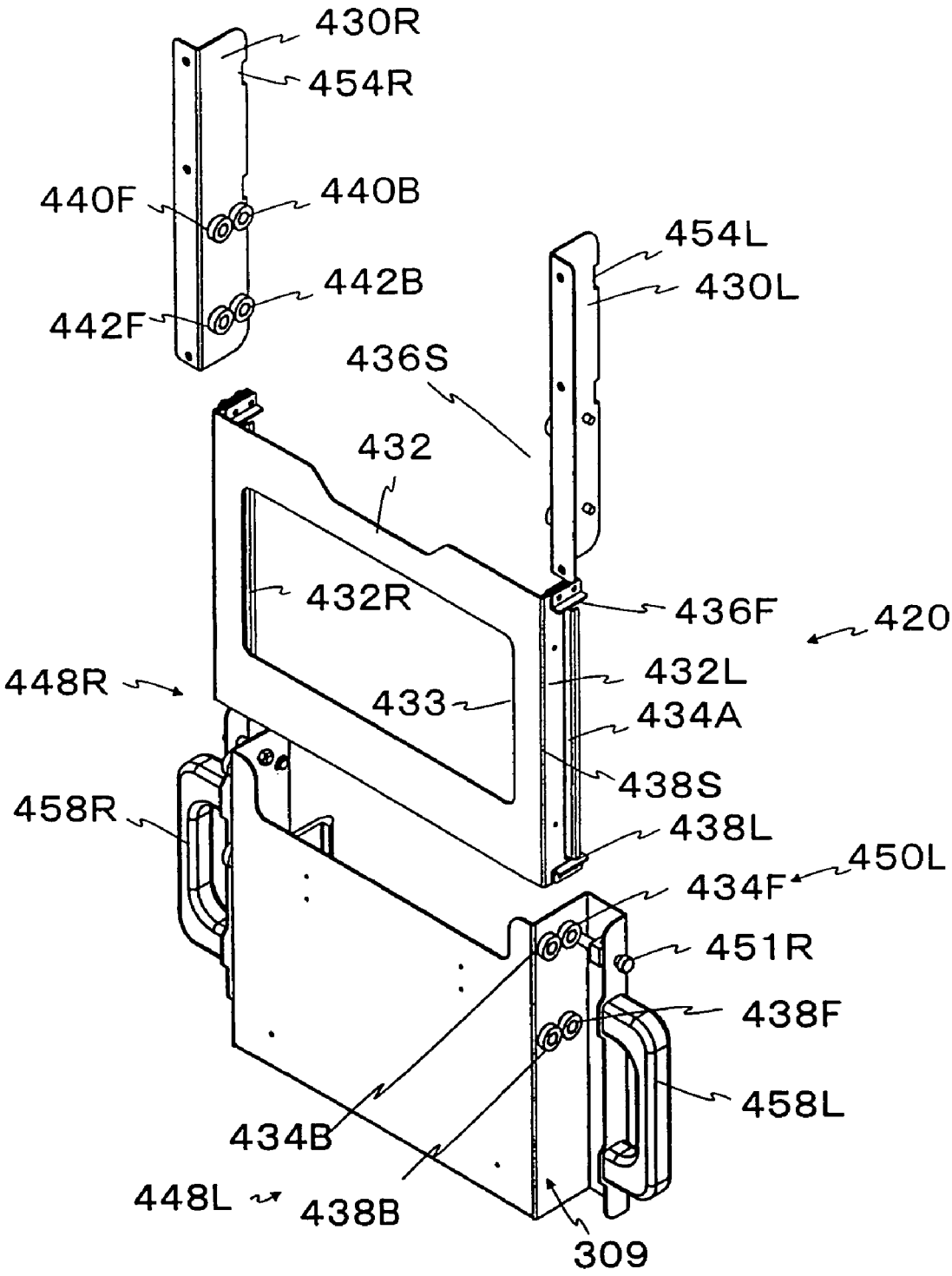
FIG. 22 is an exploded perspective view of a selecting attaching unit from the rear side for an automatic coin aligning apparatus in accordance with an embodiment of the present invention.

In reference to FIGS. 21 and 22, the expanding unit 426 is shown and explained. The expanding unit 426 is operable to selectively position the holding section 309 at either the standby position 422 or the supplying position 424. The expanding unit 426 can be changed to another type of unit having the same function such as, for example, an air cylinder.

The expanding unit 426 includes a left expanding unit 426L and a right expanding unit 426R located on the left and the right sides, respectively, of the holding section 309. Expanding units 426L and 426R are similar structures and located symmetrically, so only the left expanding unit 426L is explained in detail. In this manner, when the corresponding parts of the right expanding unit, such as 426R, include the same reference number or the letter designation "R", the explanation may be omitted.

In reference to FIG. 14, the left guiding plate 430L is affixed perpendicularly at the front wall 428 of the enclosure 302. The sliding plate 432 is attached at the left guiding plate 430L and is operable to slide in an up and down manner. An opening 433 is rectangular in shape and is located at the middle of the sliding plate 432. When the holding section 309 is located at the supplying position 424, the opening 433 is located facing the lower section of lower chute section 342. Therefore, the coins which have slid down at guiding grooves 362A-362H fall into the coin storing section 308. The left moving plate 432L is located at the left end of the sliding plate 432 adjacent to the inside of the left guiding plate 430L. The right moving plate 432R is located at the right end of the sliding plate 432 adjacent to the inside of right guiding plate 430R.

An outside guiding rail 434A extends vertically and is fixed at the outside of left moving plate 432L. An inside guiding rail 434B extends vertically and is fixed at the inside of the left moving plate 432L. A first upper stopper 436F extends horizontally and is fixed at the left moving plate 432L facing the upper section of outer guiding rail 434A. A first lower stopper 438F extends horizontally and is fixed at the left moving plate 432L facing the lower section of outer guiding rail 434A. Similarly, a second upper stopper 436S extends horizontally and is fixed at left moving plate 432L facing the upper section of inner guiding rail 434B. A second lower stopper 438S extends horizontally and is fixed at left moving plate 432L and is located face to face with the lower section of inner guiding rail 434B.

A movable guide 444R includes a pair of bearings (440F, 440B) and (442F, 442B) which are located in parallel horizontally and is located at the inner surface at left guiding plate 430R. It is preferable to construct the bearings from a resin to avoid the need for lubrication and to buffer an impact. The outside guiding rail 434A is held between the left bearings and the right bearings, therefore the sliding plate 432 can be moved in an up and down manner while remaining parallel. When the sliding plate 432 is moved in a downward direction, the first upper stopper 436F is stopped by rollers (440F, 440B).

Figure 15:
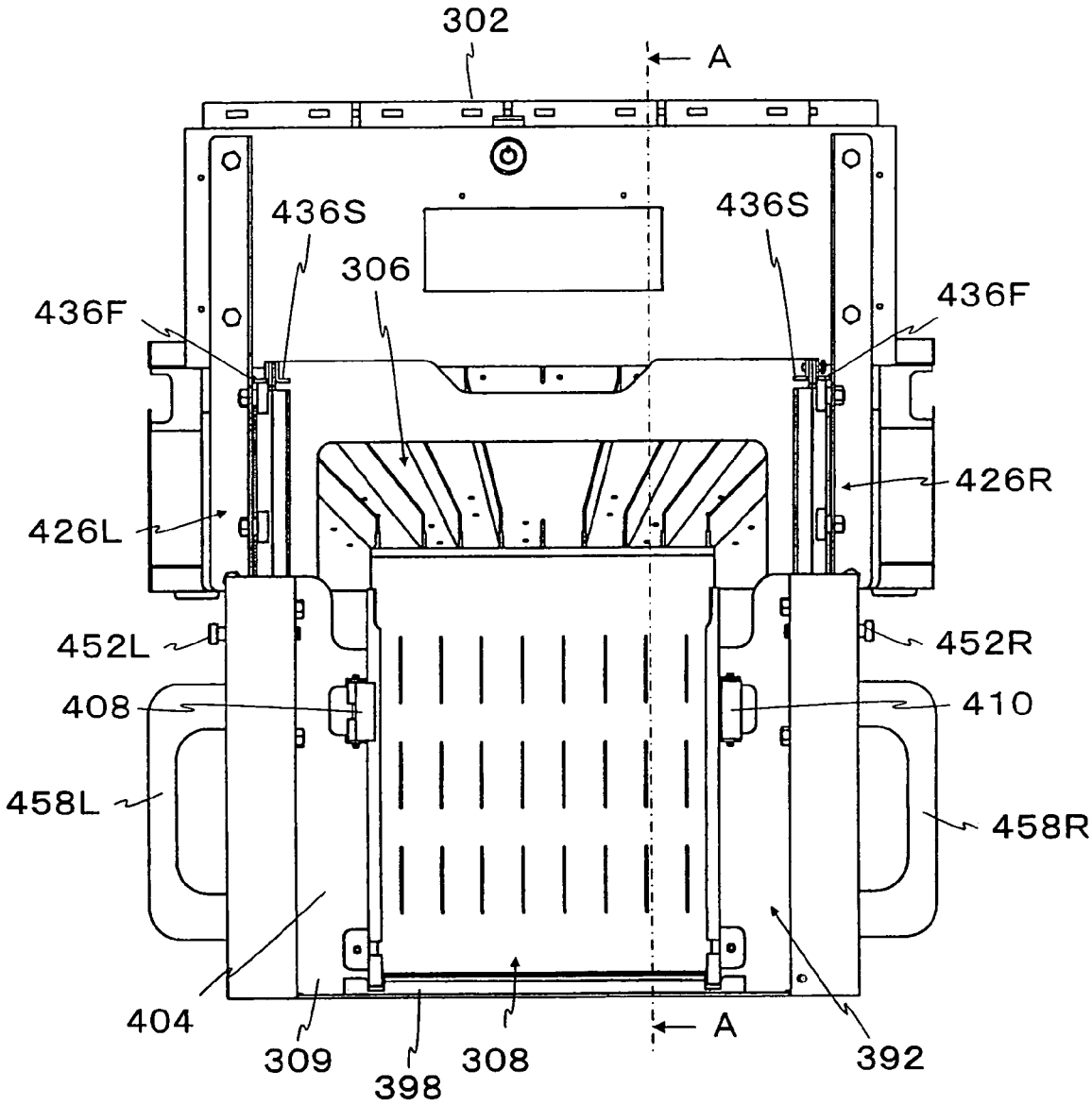
FIG. 15 is a front planar view of the automatic coin aligning apparatus shown in the supplying condition in accordance with an embodiment of the present invention.

A second movable guide 448L, which includes roller bearings similar to the movable guide 448R, is attached at the upper sections of the left side wall 446L and the right side wall 446R of holding section 309. An inner guiding rail 433B is located between rollers (434F, 134B, 438F, 438B) of the second movable guide 448L, and holding section 309 can be moved up and down parallel to sliding plate 432. When the holding section 309 moves in a downward direction, the lower rollers (438F, 438B) are stopped by second lower stopper 438S, as shown in FIGS. 14-15 and 18. The standby holding units (450L, 450R) are attached at the upper sections of the left side wall 446L and the right side wall 446R. The standby holding units 450L and 450R are operable to hold the holding section 309 at a predetermined position and can be changed to another type of unit having the same function.

In this embodiment, standby holding units 450L and 450R include tiered pins 452L and 452R which can move to the left side wall 446 and right side wall 446R horizontally, as shown in FIG. 16. The tiered pins 452L and 452R can be pushed inwards by springs (not shown) until larger diameter middle sections (454L, 456R) are stopped by left side wall 446L and right side wall 446R and are located facing notches (456L, 456R) which are located at the upper sections of guiding plates 430L and 430R. When the tiered pins (452L, 452R) are moved inside to the side walls (446L, 446R) the larger diameter middle sections (454L, 454R) are displaced from the notches (456L, 456R) so that the holding section 309 can be moved in a vertically downward direction.

A pair of handles (458R, 458L) are channel like in shape and are affixed to the outside of the side walls (446R, 446L) respectively. The handles 458R and 458L may be grasped by the hand of an operator (user) in order to move the selective attaching unit 420 in an up and down manner. The tiered pins (452L, 452R) are located in a position above and adjacent to the handles (458R, 458L) so that the tiered pins may be operated by hands while grasping the handles (458R, 458L).

Figure 23:
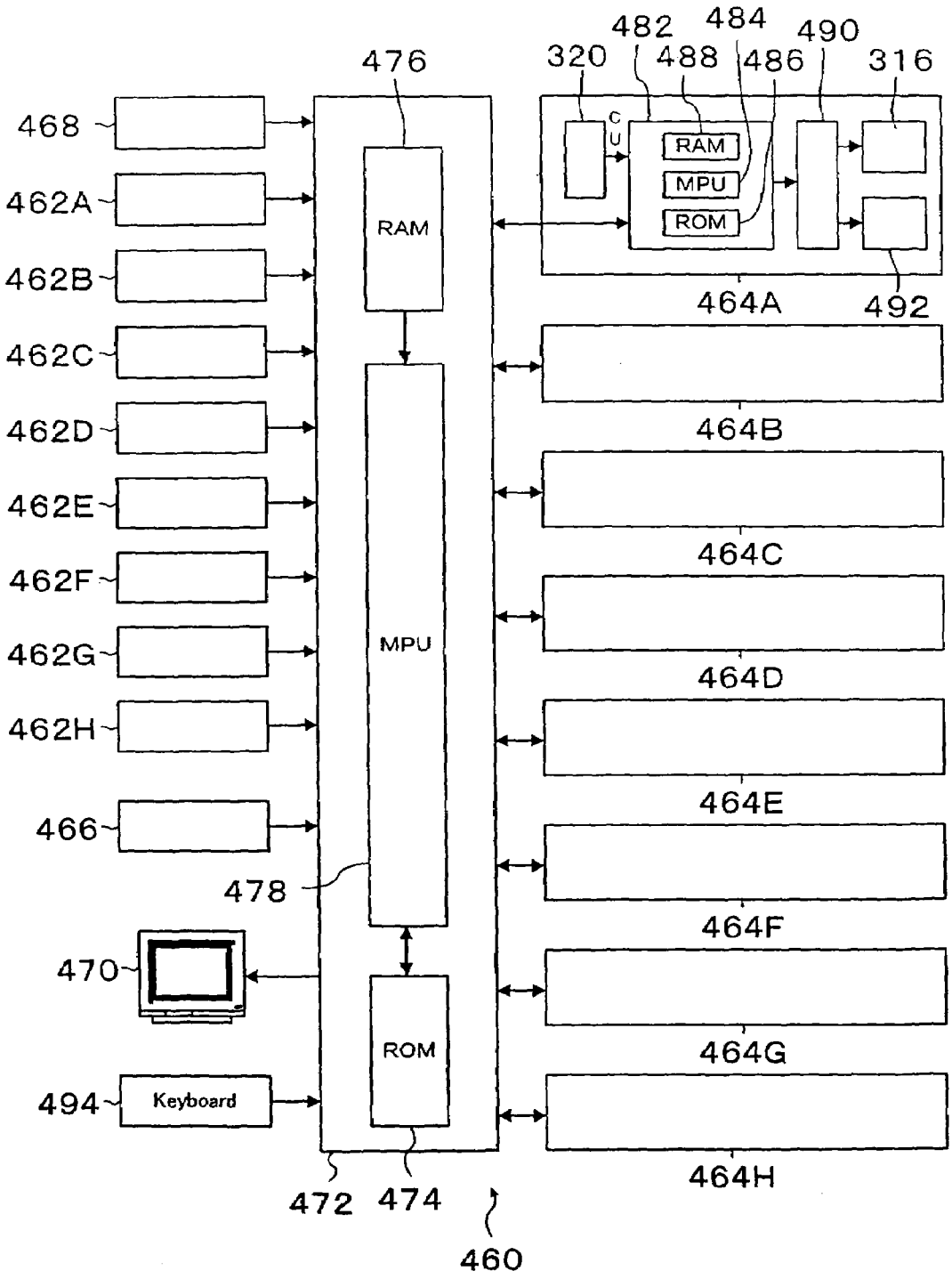
FIG. 23 is a block diagram showing a control unit and a coin hopper controller in accordance with an embodiment of the present invention.
Figure 24:
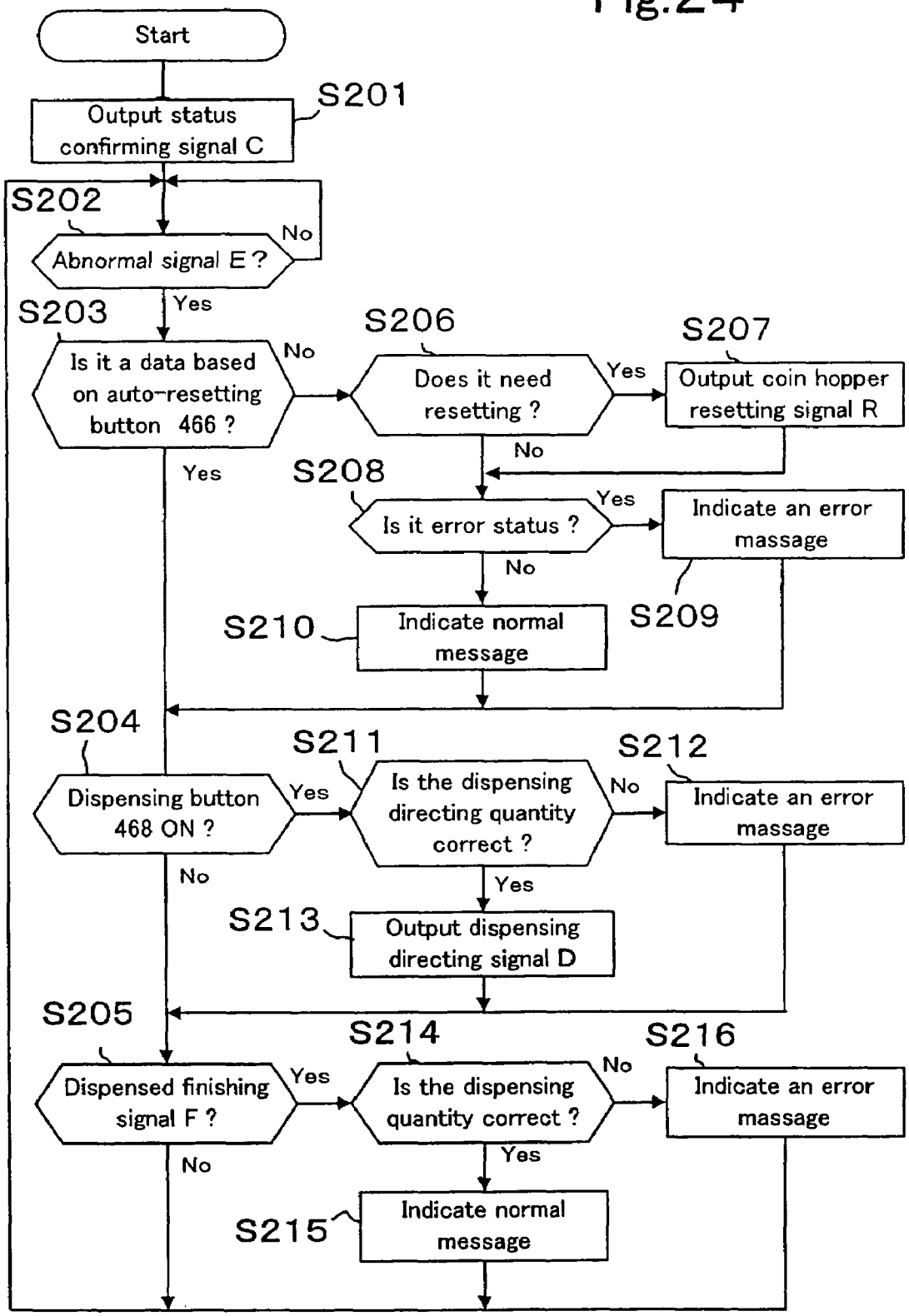
FIG. 24 is a flow diagram showing the operation of a dispensing processing unit in accordance with an embodiment of the present invention.

In reference to FIGS. 23-25, the dispensing controlling unit 460 for controlling the dispensing of coins from the plurality of coin hoppers 312A-312H is shown and explained. The dispensing control unit 460 controls each of the plurality of coin hoppers 312A-312H in order to dispense from each of the coin hoppers 312 a predetermined quantity of coins based on predetermined settings, transient conditions, and the actuation of various user controls. The quantity of coins dispensed by each of the plurality of coin hoppers 312 can be different. Alternatively, for some or all of the coin hoppers 312, the number of dispensed coins can be equal.

The dispensing control unit 460 includes a plurality of setting units 462A-462H, an automatic reset button 466, a dispensing button 468, a user display 470, and a dispensing processing unit 472. Each setting unit 462 determines the dispensing quantity of its associated coin hopper 312 with reference 462A identifying the "No. 1 hopper dispensing quantity setting circuit", and reference 462H identifying the "No. 8 hopper dispensing quantity setting circuit" so that the setting units 462A-462H correspond with hopper numbers 1-8 respectively. The automatic reset button 466 and the dispensing button 468 can be switches that are selectively activated by a user. The user display 470 can indicate to a user the status of the automatic coin aligning apparatus showing either a normal condition or an abnormal or error condition exists. This display can include colors, text, and graphics to communicate the current status to a user.

The dispensing processing unit 472 can receive signals from the setting units 462A-462H, the automatic resetting button 466, the dispensing button 468, and the keyboard 494, and output signals to the coin hopper control units 464A-464H and the display unit 470. The keyboard unit 494 may be continuously connected to the dispensing processing unit 472 or may be temporarily connected for use during maintenance or when loading new programming information, for example. The dispensing processing unit 472 includes a Microprocessor Unit (MPU) 478 such as a programmable microprocessor, a Read Only Memory (ROM) 474, and a Random Access Memory (RAM) 476.

The MPU 478 executes a program stored in the ROM 474 and can read and write intermediate data to the RAM 476. Each of the coin hopper dispensing quantity setting circuits 462 can be implemented as one or more memory locations so that a dispensing quantity is determined by examining the contents of one or more predetermined memory locations. Alternatively, the coin hopper processing unit 472 can be implemented with a logic circuit or an execution unit for executing a program in a file format instead of a programmable processor.

Each coin hopper 312 includes a coin hopper control unit 464 for receiving control signals from the dispensing processing unit 472 and operating the coin hopper 312 in order to dispense the required quantity of coins. Each coin hopper control unit 464 includes a sensor unit 320 for detecting a coin dispensed by the coin hopper 312 and outputting a coin detection signal CU. Each coin hopper control unit 464 includes a coin hopper processing unit 482 having a Microprocessor Unit (MPU) 484 such as a programmable microprocessor, a Read Only Memory (ROM) 486, and a Random Access Memory (RAM) 488. It is understood that the ROM 474 and ROM 486 can include a programmable ROM (PROM), an Ultra-Violet PROM (UVPROM), an Electrically Erasable PROM (EEPROM), or other configurable memory unit that is designed to be read from during normal, in-circuit operations but may be altered under certain special conditions. The MPU 484 executes a program stored in the ROM 486 and can read and write intermediate data to the RAM 488.

Alternatively, the coin hopper processing unit 482 can be implemented with a logic circuit or an execution unit for executing a program in a file format instead of a programmable processor. The coin hopper processing unit 482 asserts a control signal to a driving circuit 490 that will send a motor control signal to a motor unit 316 and a brake control signal to a braking circuit 492. The motor control signal activates or deactivates the motor unit 316 that operates the rotating disk 318. The brake control signal activates or deactivates the braking circuit 492 to more precisely control the rotation of the rotating disk 318.

Each coin hopper processing unit 482 receives control signals from the dispensing processing unit 472 and the coin hopper sensor unit 320 associated with the particular coin hopper 312 where the coin hopper processing unit 482 resides. Each coin hopper control unit 464 also returns status information to the dispensing processing unit 472 indicating whether or not the required number of coins have been properly dispensed or to indicate an error condition. An error condition can include dispensing an improper amount of coins, for example.

Actuating the automatic reset button 466 causes each of a plurality coin hopper control units 464A-464H to be reset to an idle state where coins are not dispensed. When the dispensing button 468 is actuated by a user the coin hopper control units 464A-464H begin dispensing coins according to their preprogrammed parameters and any user inputs. The processing unit 472 detects the actuation of the dispensing button and asserts a signal to the predetermined coin hopper control units 464 causing them to start dispensing coins according to the program stored in their ROM 486 and current conditions. This program can determine whether or not a particular coin hopper 312 is activated, and if so how many coins are dispensed. If a coin hopper 312 is activated, the associated motor 316 is activated and coins in the associated coin hopper bowl 314 are dispensed in a one by one manner.

Once the predetermined number of coins are dispensed as sensed by the sensor unit 320, the driving circuit 490 deactivates the motor 316 and activates the braking circuit 492 in order to stop the rotation of the rotating disk 318. This causes the rotating disk 318 to stop promptly and ensures an additional coin is not erroneously dispensed. Where two or more coin hoppers 312 dispense the same denomination, a single control signal may be asserted from the dispensing processing unit 472 to the same denomination coin hoppers 312. For example, the 1-cent coin hoppers (312B, 312C, and 312F) can all receive the same control signal indicating the command to dispense a predetermined quantity of 1-cent coins. In this case, only a single coin hopper dispensing quantity setting unit 462B may be used, simplifying the programming and hardware requirements for the present invention.

As an initial condition of the dispensing control unit 460, the dispensing quantities of the coin hopper dispensing setting circuits 462 are each preset to a predetermined value. For example, a default quantity of 100 coins could be set into each coin hopper dispensing quantity setting circuit. The default quantity can be changed by entering a change to the program or else by changing the contents of the memory locations storing the dispensing quantity for a particular coin hopper 312. In this case, the keyboard 494 can be used to enter a change to the program or the memory data in a dispensing quantity setting mode which is different from the normal operational mode of the dispensing control unit 460. Alternatively, the dispensing quantity can be changed by incorporating the contents of a file into either the RAM or ROM memories.

Before the operation of the coin aligning apparatus 300, if the holding section 309 is in the standby position 424, the holding section 309 must first be moved to the supplying position 424 by grasping the handles (458L, 458R), actuating the tiered pins (452L, 452R), and then sliding the holding section 309 to the supplying position 424. For example, the handles (458L, 458R) may be held by the middle fingers of each hand while the heads of the tiered pins (452L, 452R) are pushed in an inward direction by the thumbs. In this manner, the tiered pins (452L, 452R) are moved toward each other and the larger diameter section of the pins (452L, 452R) are displaced from the notches (456L, 456R) allowing the holding section 309 to be moved in a downward direction.

When the holding section 309 is moved in a downward direction, the sliding plate 432 is moved to a position where the upper stopper 436F is stopped by rollers (440B, 440F) and the second moving guides (448L, 448R) are stopped by the lower stopper 438S. When the holding section 309 is stopped by the upper stopper 436S and the lower stopper 438S, it is located at the supplying position 424. In this supplying position 424, the coin storing unit 308 with auxiliary cover 382 is attached to the holding section 309.

In reference to FIGS. 24 and 25, the operation of the automatic coin dispensing and aligning apparatus 300 is shown and explained in terms of the operation of the dispensing control unit 460 and one of the plurality of coin hopper control units 464. When the automatic reset button 466 is actuated the dispensing processing unit 472 then enters an "Output Status Confirming Signal C" step S201 and communicates with each of the coin hopper processing units 482 causing each of them to enter their "Initial Setting" step H201.

The coin hopper processing units 482 are reset in step H201 and control passes within the coin hopper control unit 464 to a "Memorize" step H202. If an abnormal condition is detected, an abnormal signal E is stored in step H202. Conversely if a normal condition is detected, a normal signal N is stored in step H202. Following a reset caused by actuation of the automatic reset button 466, the coin hopper control unit 464 will store an abnormal signal E. Once either the signal E or the signal N is stored, control passes within the coin hopper control unit 464 to a "Status Confirming Signal C?" step H203.

In step H203 the presence of the signal C from the dispensing processing unit 472 is detected. The coin hopper processing unit 482 will remain in step H203 until the signal C is detected from the dispensing processing unit 472. Once the signal C is detected, control passes within the coin hopper processing unit 482 to an "Output Abnormal Signal E or Normal Signal N" step H204.

In step H204 the signal (either E or N) stored in step H202 is asserted to the dispensing processing unit 472 and control passes within the coin hopper processing unit 482 to a "Dispensing Signal D?" step H205.

In step H205, a dispensing direction signal D is detected from the dispensing processing unit 472. The dispensing direction signal D is a command to dispense the predetermined quantity of coins from the coin hopper 312 receiving the signal D. If the dispensing signal D is not detected, control passes within the coin hopper processing unit 482 to step H202. If the dispensing signal D is detected, control passes within the coin hopper processing unit 482 to a "Memorize Dispensing Directing Quantity" step H206.

After entering the "Output Status Confirming Signal C" step S201, control passes within the dispensing processing unit 472 to an "Abnormal Signal E or Normal Signal N?" step S202 where either an abnormal signal E or a normal signal N is detected as asserted by the coin hopper processing units 482. Once one of the status situation signals E or N are detected, control within the dispensing processing unit 472 passes to a "Is It A Data Based On Auto-resetting Button 466?" step S203.

In step S203, if the abnormal signal E is due to the actuation of the automatic reset button 466, control passes within the dispensing processing unit 472 to a "Dispensing Button 468 ON" step S204 since this is a normal condition following actuation of the automatic reset button 466. However, in step S203, if the abnormal signal E is not due to the actuation of the automatic reset button 466, control passes within the dispensing processing unit 472 to a "Does It Need Resetting?" step S206.

In step S204, actuation of the dispensing button 468 is detected. If the actuation of the dispensing button 468 is detected, then the dispensing processing unit 472 proceeds with the dispensing process described in reference to step H205 above and control within the dispensing processing unit 472 passes to an "Is The Dispensing Directing Quantity Correct?" step S211. Conversely, if the actuation of the dispensing button 468 is not detected, then the dispensing processing unit 472 proceeds with the detecting of a dispensing finished signal F and control within the dispensing processing unit 472 passes to in a "Dispensed Finishing Signal F?" step S205.

In step S205, if the dispensing finished signal F is detected then the coin hopper 312 is indicating it has finished dispensing a quantity of coins and control passes within the dispensing processing unit 472 to an "Is The Dispensing Quantity Correct?" step S214. Conversely, if the dispensing finished signal F is not detected then the coin hopper 312 is not indicating it has finished dispensing a quantity of coins and control passes within the dispensing processing unit 472 back to "Abnormal Signal E or Normal Signal N?" step S202. Thus, following a reset condition, the dispensing processing unit 472 will continuously loop through step S202 ->step S203 ->step S204 ->step S205 repeating until activation of the dispensing button 468 is detected, the dispensing finished signal F is detected, or until an abnormal signal E that is not due to the actuation of the automatic reset button 466 is detected.

In step S206, an abnormal signal E has been detected that is not due to the actuation of the automatic reset button 466. In this step, a determination is made whether the abnormal signal E needs to be reset. This can occur in a variety of settings, and includes the condition where a coin hopper 312 is erroneously indicating an abnormal condition when none exists. In this case, it may be desirable to mask off this abnormal signal E so as not to interfere with the operation of the other coin hoppers 312. If the abnormal signal E needs to be reset, control within the dispensing processing unit 472 passes to an "Output Coin Hopper Resetting Signal R" step S207. If the abnormal signal E does not need to be reset, control within the dispensing processing unit 472 passes to an "Is It Error Status?" step S208.

In step S207, a coin hopper reset signal R is asserted to a coin hopper 312 that asserted an abnormal signal E that is not due to the actuation of the reset button 466 causing the coin hopper 312 to reset itself, and control within the dispensing processing unit 472 passes to step S208.

In step S208, if the abnormal signal E is again detected. If the abnormal signal E is still present, control within the dispensing processing unit 472 passes to an "Indicate An Error Message" step S209. If the abnormal signal E is no longer present, control within the dispensing processing unit 472 passes to an "Indicate A Normal Message" step S210.

In step S209, an error message is asserted to the display 470 and processing within the dispensing processing unit 472 halts to indicate service is needed. Actuation of the reset button 466 will place the dispensing processing unit 472 into an initial state S201.

In step S210, a normal (non-error) message is asserted to the display 470 and control within the dispensing processing unit 472 passes to step S205.

In step S211, actuation of the dispensing button 468 has been detected and a determination is made as to whether the dispensing directing quantity is correct. If the dispensing directing quantity is not correct, control within the dispensing processing unit 472 passes to an "Indicate An Error Message" step S212. If the dispensing directing quantity is correct, control within the dispensing processing unit 472 passes to an "Output Dispensing Directing Signal D" step S213.

In step S212, the dispensing directing quantity is not correct and an error message is asserted to the display 470 and processing within the dispensing processing unit 242 halts to indicate service is needed. Actuation of the reset button 466 will place the dispensing processing unit 472 into an initial state S201.

In step S213, the dispensing quantity is determined to be correct and the dispensing directing signal D is asserted to the selected coin hopper 312. Once the dispensing directing signal D is asserted, control within the dispensing processing unit 472 passes to step S205. Returning to the state of the coin hopper processing unit 482, when the dispensing signal D is detected, control passes to step H206.

In step H206, the coin hopper processing unit 482 stores a dispensing directing quantity and control passes to a "Driving Circuit 490 ON" step H207.

In step H207, the driving circuit 490 is activated so that the motor 316 is activated causing the rotating disk 318 to begin rotating and control passes to a "Detecting Signal CU?" step H208.

In step H208, coins are dispensed by the rotating disk 318 in a one by one manner. The sensor unit 320 detects each coin as it is dispensed and outputs a detecting signal CU. If a dispensed coin is not detected, control remains in step H208 waiting for the signal CU. If a dispensed coin is detected, control passes to a "Count" step H209.

In step H209, the count of the signal CU is accumulated with a previous dispensing count value to indicate a current dispensing count value and control passes to an "Is It The Same To The Directing quantity?" step H210. The previous dispensing count value is initialized to a value of zero prior to the first accumulation.

In step H210, the current dispensing count value is compared with the dispensing directing quantity. If the current dispensing count value is the same as the dispensing directing quantity, then the correct number of coins have been dispensed and control passes to a "Driving Circuit 490 OFF Braking Circuit 492 ON" step H211. Conversely, if the current dispensing count value is not the same as the dispensing directing quantity, then the correct number of coins have not yet been dispensed and control returns to step H207 to await subsequent coin dispensing signals CU.

In step H211, the driving circuit 490 disables the motor 316 and enables the braking circuit 492 so that the rotation of the rotating dispensing disk 318 will stop promptly so that no more coins will be dispensed. Control then passes to an "Output Dispensed Quantity F" step H212.

In step H212, the dispensed finishing signal F is asserted to the dispensing processing unit 472 and control passes within the coin hopper processing unit 482 to step H202. All coin hopper control units 464A-464H will behave the same under normal conditions except for the possibility of counting a different number of dispensed coins.

Returning to the dispensing processing unit 472, in step S214, the dispensing finished signal F has been detected and a determination is made whether the dispensing quantity is correct. If the dispensing quantity is not correct, control within the dispensing processing unit 472 passes to an "Indicate An Error Message" step S216. Conversely, if the dispensing quantity is correct, control within the dispensing processing unit 472 passes to an "Indicate Normal Message" step S215.

In step S215, a normal (non-error) message is asserted to the display 470 and control within the dispensing processing unit 472 passes to step S202.

In step S216, the dispensing quantity is not correct and an error message is asserted to the display 470 and processing within the dispensing processing unit 472 halts to indicate service is needed. Actuation of the reset button 466 will place the dispensing processing unit 472 into an initial state S201.

Afterward the coin supplying operation is completed, the holding section 309 can be returned to the standby position 422. To accomplish this, the handles (458L, 458R) are grasped as described above, the tiered pins (452L, 452R) are operated to displace the larger diameter middle sections (454L, 456R) from the notches (456L, 456R), and the handles (458L, 458R) are lifted in an upward direction. In this manner, the second auxiliary guides (448L, 448R) push up against the upper stopper 436S and the sliding plate 432 is lifted up together with the second auxiliary guides. When the tiered pins (452L, 452R) are located facing the notches (456L, 456R), the tiered pins (452L, 452R) are released and they are returned under the force of springs (not shown) to where the larger diameter middle sections (454L, 456R) are stopped by left side wall 446L and right side wall 446R and are located facing notches (456L, 456R) to retain the holding section 309 at the standby position 422.

At this point, the dispensing of the coins has finished and the moving holders (408, 410) may be pivoted so that the coin storing unit 308 can be removed from the holding section 309 and the coin storing unit 308 removed from the providing position 228.

In reference to FIG. 20, once the coin storing unit 308 is loaded with predetermined quantity of coins according to their denomination through the previously described procedure, the auxiliary cover 382 can be removed from the coin storing body 16 and replaced with a coin storing body cover 22 by sliding the edges of the coin storing body cover 22 within the sliding grooves 184 as described above, and now as shown in FIG. 26. Once the coin storing body cover 22 is mounted on the coin storing body 16 containing the stacked coins, the coin storing body 16 may be used in a coin dispensing system.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. An automatic coin aligning apparatus, comprising:

an array of coin hoppers including at least a first line of coin hoppers and a second line of coin hoppers, each coin hopper for storing a bulk quantity of coins of a predetermined denomination and dispensing coins in a one by one manner;

a coin sorting unit operatively connected to each coin hopper to dispense coins individually through a coin dispensing slot, the dispensing slots of the first line of coin hoppers face the dispensing slots of the second line of coin hoppers;

an upper chute section having upper chutes connected to each of the dispensing slots to enable a gravity release of dispensed coins, the upper chutes in a perpendicular arrangement and standing side-by-side;

a first buffering unit attached to each upper chute section for absorbing kinetic force of the dispensed coin from the dispensing slot for slowing of the dispensed coin, the first buffering unit includes a first buffering body which is plate shaped and extends across a guiding passageway and configured to swing on a first shaft when struck by the dispensed coin to absorb the kinetic force and slightly slants in an idle state under the force of gravity;

a lower chute section having lower chutes connected to each upper chute for receiving the dispensed coin as the dispensed coin further descends by gravity, the lower chute section dispensed at an angle of between about 20 degrees to about 40 degrees as measured from a horizontal point of reference, and slants side-by-side, and the width of a lower end of the lower chute section being narrower than the width of an upper end;

a second buffering unit attached under the first buffering unit to guide the dispensed coin to slide along the lower chute section and to prevent rolling of the dispensed coin on its edge wherein the dispensed coin is controlled in its further descent, the second buffering unit includes a second buffering body which is plate shaped and is configured to swing on a second shaft when struck by the dispensed coin to absorb a kinetic force, and a coin turning body for causing the dispensed coin to turn over upon striking the coin turning body, the second buffering body slightly slants in a normal condition under the force of gravity; and a removable coin storing unit having a plurality of coin storing sections, each coin storing section for receiving a predetermined quantity of coins from one of the array of coin hoppers.

2. The automatic coin dispensing apparatus of claim 1 wherein ends of the coin sorting units include a rotary disk.

3. The automatic coin dispensing apparatus of claim 1 wherein the coin hoppers of the first line are offset from the coin hoppers of the second line.

4. The automatic coin dispensing apparatus of claim 3 wherein the upper chute sections of the first line are offset from the upper chute section of the second line.

5. The automatic coin dispensing apparatus of claim 1 wherein the removable coin storing unit is held by moving holders which releasably grasp the coin storing unit.

6. The automatic coin dispensing apparatus of claim 1 wherein each coin hopper includes a slanting base and a guiding passageway extending perpendicularly from the dispensing slot and disposed parallel to the slanting base, the guiding passageway having a lower portion disposed over the upper chute section.

7. The automatic coin dispensing apparatus of claim 1 wherein a dispensing control unit for controlling the coin dispensing quantity of the array of coin hoppers.

8. The automatic coin dispensing apparatus of claim 1 further including a coin turning plate.

9. The automatic coin dispensing apparatus of claim 1 having a unitary cover member to cover each of the array of coin hoppers.

10. A method of dispensing and aligning coins for storage comprising:

providing an array of coin hoppers including at least a first line of coin hoppers and a second line of coin hoppers, each coin hopper for storing a bulk quantity of coins of a predetermined denomination and dispensing coins in a one by one manner; and a coin sorting unit operatively connected to each coin hopper to dispense coins individually through a coin dispensing slot, the dispensing slots of the first line of coin hoppers face the dispensing slots of the second line of coin hoppers;

arranging an upper chute section having an upper chute connected to each of the dispensing slots to enable a gravity release of a dispensed coin in a central location between the coin hoppers;

buffering with a first buffering unit attached to each upper chute for absorbing kinetic force of the dispensed coin from the dispensing slot for slowing of the dispensed coin, the first buffering unit including a first buffering body which is plate shaped and extends across a guiding passageway and configured to swing on a first shaft when struck by the dispensed coin to absorb the kinetic force;

arranging a lower chute section having a lower chute connected to each upper chute section for receiving the dispensed coin as the dispensed coin further descends by gravity;

guiding the dispensed coin with a second buffering unit to guide the dispensed coin to slide along the lower chute section and to prevent rolling of the dispensed coin on its edge whereby the dispensed coin is controlled in its further descent, the second buffering unit including a second buffering body which is plate shaped and is configured to swing on a second shaft when struck by the dispensed coin to absorb a kinetic force, and a coin turning body for causing the dispensed coin to turn over upon striking the coin turning body; and storing the dispensed coin in a removable coin storing unit having a plurality of coin storing sections, each coin storing section for receiving a predetermined quantity of coins from one of the array of coin hoppers.

11. An automatic coin dispensing apparatus, comprising:

an array of coin hoppers including at least a first line of coin hoppers and a second line of coin hoppers, each coin hopper for storing a bulk quantity of coins of a predetermined denomination and dispensing coins in a one by one manner;

a coin sorting unit operatively connected to each coin hopper to dispense coins individually through a coin dispensing slot, the dispensing slots of the first line of coin hoppers face the dispensing slots of the second line of coin hoppers;

an upper chute section having an upper chute connected to each of the dispensing slots to enable a gravity release of a dispensed coin in a central location between the coin hoppers;

a first buffering means, attached to each upper chute, for absorbing kinetic force of the dispensed coin from the dispensing slot;

a lower chute section having a lower chute connected to each upper chute for receiving the dispensed coin as the dispensed coin further descends by gravity;

a second buffering means for absorbing kinetic force and guiding the dispensed coin to slide along the lower chute section and to prevent rolling of the dispensed coin wherein the dispense coin is controlled in its further descent; and a removable coin storing unit having a plurality of coin storing sections, each coin storing section for receiving a predetermined quantity of coins from one of the array of coin hoppers.

12. The automatic coin dispensing apparatus of claim 11, wherein ends of the coin sorting units include a rotary disk.

13. The automatic coin dispensing apparatus of claim 11, wherein the coin hoppers of the first line are offset from the coin hoppers of the second line.

14. The automatic coin dispensing apparatus of claim 11, wherein the upper chute section of the first line is offset from the upper chute section of the second line.

15. The automatic coin dispensing apparatus of claim 11, wherein the lower chute section is dispensed at an angle of between about 20 degrees to about 40 degrees as measured from a horizontal point of reference.

16. The automatic coin dispensing apparatus of claim 11, wherein the removable coin storing unit is held by moving holders which releasably grasp the coin storing unit.

17. The automatic coin dispensing apparatus of claim 11, wherein each coin hopper includes a slanting base and a guiding passageway extending perpendicularly from the dispensing slot and disposed parallel to the slanting base, the guiding passageway having a lower portion disposed over the upper chute section.

18. The automatic coin dispensing apparatus of claim 11, wherein a dispensing control unit for controlling the coin dispensing quantity of the array of coin hoppers.

* * * * *